US011885512B2

(12) United States Patent
Akaiwa et al.

(10) Patent No.: US 11,885,512 B2
(45) Date of Patent: Jan. 30, 2024

(54) HEAT EXCHANGER AND REFRIGERATION CYCLE DEVICE

(71) Applicant: Mitsubishi Electric Corporation, Tokyo (JP)

(72) Inventors: Ryota Akaiwa, Tokyo (JP); Makoto Tanishima, Tokyo (JP); Yoji Onaka, Tokyo (JP); Takamasa Uemura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 394 days.

(21) Appl. No.: 17/291,612

(22) PCT Filed: Dec. 19, 2018

(86) PCT No.: PCT/JP2018/046780
§ 371 (c)(1),
(2) Date: May 6, 2021

(87) PCT Pub. No.: WO2020/129180
PCT Pub. Date: Jun. 25, 2020

(65) Prior Publication Data

US 2022/0018553 A1 Jan. 20, 2022

(51) Int. Cl.
*F28F 9/02* (2006.01)
*F24F 1/14* (2011.01)
(Continued)

(52) U.S. Cl.
CPC ..... *F24F 1/14* (2013.01); *F24F 1/0068* (2019.02); *F25B 39/04* (2013.01); *F28D 1/053* (2013.01); *F28F 9/02* (2013.01)

(58) Field of Classification Search
CPC . F24F 1/14; F24F 1/0068; F25B 39/04; F28D 1/053; F28F 9/02
(Continued)

(56) References Cited

FOREIGN PATENT DOCUMENTS

EP 0 838 641 A2 4/1998
JP 4-187990 A 7/1992
(Continued)

OTHER PUBLICATIONS

Office Action dated May 20, 2022, in corresponding Chinese patent Application No. 201880100102.7 12 pages.
(Continued)

*Primary Examiner* — Davis D Hwu
(74) *Attorney, Agent, or Firm* — XSENSUS LLP

(57) ABSTRACT

A heat exchanger has first and second heat exchange units disposed one above the other. In a case where the heat exchanger functions as a condenser, refrigerant flows through the second heat exchange unit after having flowed through the first heat exchange unit. An intermediate header unit through which the first heat exchange unit and the second heat exchange unit communicate with each other causes at least a portion of refrigerant having flowed through a first heat transfer pipe group on the windward side of the first heat exchange unit to flow to a fourth heat transfer pipe group. Further, the intermediate header unit causes at least a portion of refrigerant having flowed through a second heat transfer pipe group on the leeward side of the first heat exchange unit to flow into a third heat transfer pipe group or the fourth heat transfer pipe group.

13 Claims, 16 Drawing Sheets

(51) Int. Cl.
*F24F 1/0068* (2019.01)
*F25B 39/04* (2006.01)
*F28D 1/053* (2006.01)

(58) Field of Classification Search
USPC ..... 165/175
See application file for complete search history.

(56) References Cited

FOREIGN PATENT DOCUMENTS

| | | | |
|---|---|---|---|
| JP | 2013-11393 | A | 1/2013 |
| JP | 2014-196856 | A | 10/2014 |
| JP | 2017-15363 | A | 1/2017 |
| JP | WO2017073096 | A1 * | 5/2017 |

OTHER PUBLICATIONS

Extended European Search Report dated Nov. 9, 2021, in corresponding European patent application No. 18944108.2.
International Search Report and Written Opinion dated Feb. 12, 2019, received for PCT Application PCT/JP2018/046780, Filed on Dec. 19, 2018, 11 pages including English Translation.

* cited by examiner

HEAT EXCHANGER AND REFRIGERATION CYCLE DEVICE

CROSS-REFERENCE TO RELATED APPLICATION

The present application is based on PCT filing PCT/JP2018/046780, filed Dec. 19, 2018, the entire contents of which are incorporated herein by reference.

TECHNICAL FIELD

The present disclosure relates to a heat exchanger configured to cause heat exchange to be performed between refrigerant and air that pass through heat transfer pipes and to a refrigeration cycle device.

BACKGROUND ART

Hitherto, there has been a heat exchanger serving, for example, as a heat exchanger for use in a car air conditioner and including a pair of headers, one above the other, that horizontally face each other, a plurality of flat heat transfer pipes connected to these headers in parallel communication at a regular spacing, and a corrugated fin interposed in a gap between flat heat transfer pipes so as to be in close contact with the flat heat transfer pipes. This heat exchanger is incorporated into a refrigeration cycle device for use, allows refrigerant serving as a heat exchange medium to flow in parallel flows simultaneously through the plurality of flat heat transfer pipes, and is utilized as a condenser that is capable of exhibiting high performance while being small in size and light in weight.

For example, Patent Literature 1 describes a heat exchanger including windward and leeward heat exchangers arranged in two rows in a direction of passage of wind. In a case where this heat exchanger functions as an evaporator, a flow of refrigerant passes through the leeward heat exchanger after passing through the windward heat exchanger. Specifically, the refrigerant having flowed into the windward-side heat exchanger branches into a plurality of refrigerants in the windward-side heat exchanger, and the plurality of refrigerants pass through the windward-side heat exchanger in downward flows in the direction of gravitational force. The refrigerants having passed through the windward-side heat exchanger merge into refrigerant that is sent to the leeward-side heat exchanger. The refrigerant sent to the leeward-side heat exchanger branches again into a plurality of refrigerants in the leeward-side heat exchanger, and the plurality of refrigerants pass through the leeward-side heat exchanger in upward flows against gravitational force. Patent Literature 1, in which all refrigerants in this refrigerant flow pass through flow passages of equal length on both the windward side and the leeward side, proposes increasing heat exchanger efficiency by ensuring uniform temperature exchange between refrigerant of each refrigerant flow passage and air.

Furthermore, in the technology of Patent Literature 1, the windward-side heat exchanger and the leeward-side heat exchanger are each divided into one flat heat transfer pipe group and another flat heat transfer pipe group to form two core units. That is, the windward-side heat exchanger is divided into a first core unit and a second core unit, and the leeward-side heat exchanger is divided into a third core unit and a fourth core unit. Moreover, the first core unit and the third core unit are connected in series to form a flow passage, and the second core unit and the fourth core unit are connected in series to form a flow passage. With this configuration, the technology of Patent Literature 1 reduces deterioration of heat exchanger performance resulting from non-uniformity in refrigerant distribution.

CITATION LIST

Patent Literature

Patent Literature 1: Japanese Unexamined Patent Application Publication No. 2017-15363

SUMMARY OF INVENTION

Technical Problem

However, in a case where the heat exchanger described in Patent Literature 1 functions as a condenser, refrigerant flows in a direction opposite to the direction in which it flows in a case where the heat exchanger functions as an evaporator. This produces the following problems. High-temperature gas refrigerant flows into the leeward-side heat exchanger first and then undergoes a phase change from single-phase gas refrigerant to two-phase gas-liquid refrigerant through heat exchange with air while flowing downward through the leeward-side heat exchanger. The two-phase gas-liquid refrigerant having passed forms an upward flow against gravitational force in the windward-side heat exchanger. Due to the formation of the upward flow by the two-phase gas-liquid refrigerant in the windward-side heat exchanger, a portion of liquid refrigerant cannot move upward in the windward-side heat exchanger and stays in a header provided at a lower end of the windward-side heat exchanger. In this case, it becomes necessary, as a result, to increase the amount of refrigerant that is charged into a refrigeration cycle.

Further, a heat exchanger provided with heat exchange units in a plurality of rows in a direction of flow of air and configured such that refrigerant flows in parallel flows through each separate heat exchange unit is required to realize improvement in heat exchange performance by ensuring uniform heat exchange balance between each refrigerant flow and the other.

The present disclosure has been made in view of the above circumstances and an object thereof is to provide a heat exchanger and a refrigeration cycle device that, while ensuring heat exchange balance between each refrigerant flow and the other, allow refrigerant liquefied in the heat exchanger when the heat exchanger functions as a condenser to be discharged without staying in the heat exchanger.

Solution to Problem

A heat exchange according to an embodiment of the present disclosure includes a first heat exchange unit and a second heat exchange unit disposed one above an other, the first heat exchange unit and the second heat exchange unit each having a heat transfer pipe group configured such that a plurality of heat transfer pipes, extending in a first orientation, through which refrigerant flows are arranged in parallel in a second orientation orthogonal to the first orientation, the heat transfer pipe groups of each of the first and second heat exchange units being arranged in at least two rows in a third orientation, the first orientation being an up-and-down direction, the third orientation being a flow direction of air along a horizontal direction, presuming that the heat transfer pipe groups include a first heat transfer pipe group on a windward side of the first heat exchange unit, a second heat transfer pipe group on a leeward side of the first heat exchange unit, a third heat transfer pipe group on a windward side of the second heat exchange unit, and a fourth heat transfer pipe group on a leeward side of the second heat exchange unit, the heat exchanger including an intermediate header unit through which a lower end of the first heat transfer pipe group and a lower end of the second heat transfer pipe group communicate with an upper end of the third heat transfer pipe group and an upper end of the fourth heat transfer pipe group, in a case where the heat exchanger functions as a condenser, the intermediate header unit causing at least a portion of refrigerant having flowed downward through the first heat transfer pipe group and flowed out through the lower end of the first heat transfer pipe group to flow in through the upper end of the fourth heat transfer pipe group and flow downward through the fourth heat transfer pipe group and causing a least a portion of refrigerant having flowed downward through the second heat transfer pipe group and flowed out through the lower end of the second heat transfer pipe group to flow in through the upper end of the third heat transfer pipe group or the upper end of the fourth heat transfer pipe group and flow downward through the third heat transfer pipe group or the fourth heat transfer pipe group.

Advantageous Effects of Invention

A heat exchanger according to an embodiment of the present disclosure is configured such that in a case where the heat exchanger functions as a condenser, such a flow passage is formed that refrigerant flows downward through heat transfer pipes making up the heat exchanger, whereby liquid refrigerant can be discharged without staying in the heat exchanger. Further, at least a portion of a refrigerant flow flowing through plural rows of heat transfer pipes flows while refrigerant upstream and downstream sides are swapping windward-side and leeward-side flow passages with each other, whereby heat exchange involving a great difference in temperature between refrigerant and air and heat exchange involving a small difference in temperature between refrigerant and air can be created separately on the windward side and the leeward side. This makes it possible, as a result, to ensure uniform heat exchange balance between the refrigerant upstream and downstream sides, making it possible to improve heat exchanger performance.

DESCRIPTION OF EMBODIMENTS

Figure 1:
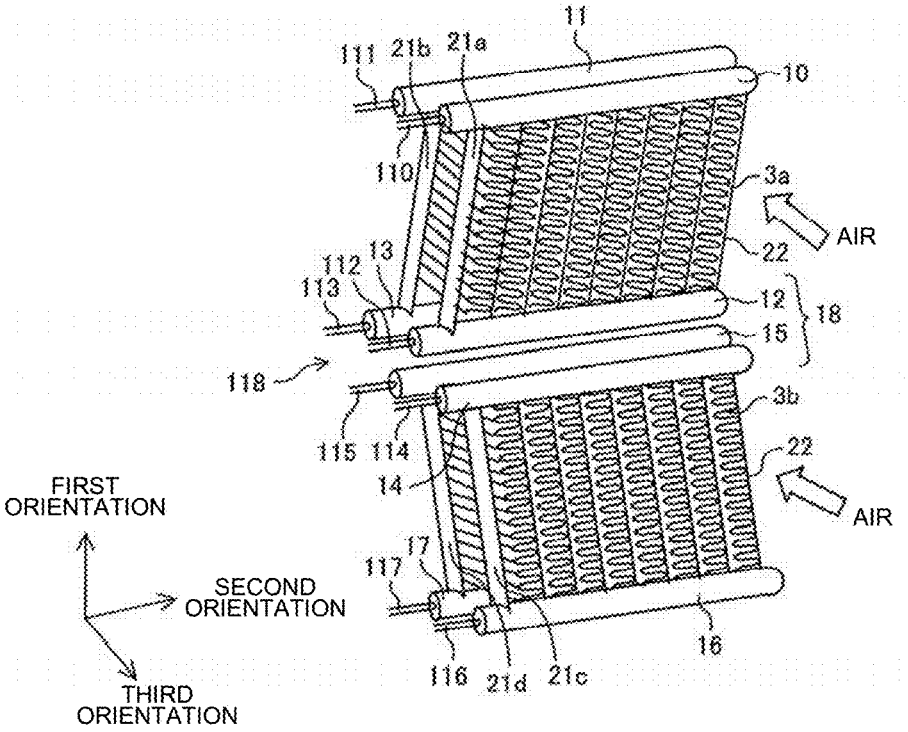
FIG. 1 is a front perspective view showing a heat exchanger according to Embodiment 1 of the present disclosure.

The following describes embodiments of the present disclosure with reference to the drawings. Note here that components given identical signs in the following diagrams including FIG. 1 are identical or equivalent to each other and these signs are adhered to throughout the full text of the embodiments described below. Further, in each embodiment, components that are identical or equivalent to those described in a preceding embodiment are given identical signs and a description of such components may be omitted. Moreover, the forms of components expressed in the full text of the specification are merely examples, and are not limited to forms described herein. Further, each of the following embodiments may be partially combined with the other even in a case where such combinations are not specified, provided that no obstacles are brought about to such combinations.

Embodiment 1

Embodiment 1 is described with reference to FIGS. 1 to 8. FIG. 1 is a front perspective view showing a heat exchanger according to Embodiment 1 of the present disclosure. In FIG. 1 and each after-mentioned drawing, the terms "first orientation", "second orientation", and "third orientation" refer to an up-and-down direction, a right-and-left direction orthogonal to the first orientation, and a horizontal direction of flow of air, respectively. Although, an arrow of the first orientation indicates a vertical direction in FIG. 1, the term "first orientation" herein encompasses a direction of tilt as well as the vertical direction and, in other words, encompasses up-and-down directions in general.

This heat exchanger is incorporated into a refrigeration cycle device to function as a condenser or as an evaporator, and has a first heat exchange unit 3*a* and a second heat exchange unit 3*b* disposed below the first heat exchange unit 3*a*. The first heat exchange unit 3*a* and the second heat exchange unit 3*b* each have heat transfer pipe groups arranged in two rows in the third orientation and each configured such that a plurality of heat transfer pipes extending in the first orientation are arranged in parallel in the second orientation. Specifically, the first heat exchange unit 3*a* has a first heat transfer pipe group 21*a* made up of a windward-side heat transfer pipe group and a second heat transfer pipe group 21*b* made up of a leeward-side heat transfer pipe group. The second heat exchange unit 3*b* has a third heat transfer pipe group 21*c* made up of a windward-side heat transfer pipe group and a fourth heat transfer pipe group 21*d* made up of a leeward-side heat transfer pipe group. It should be noted that although FIG. 1 shows a configuration in which heat transfer groups are arranged in two rows, the number of rows is not limited to 2 but may be greater than 2.

The heat exchanger, in which the heat transfer pipes are made up of flat pipes, includes a corrugated fin 22 between each flat pipe and the other. This ensures an enlargement of the area of contact with air through which an amount of heat obtained from refrigerant in the flat pipes is transferred to the air.

The heat exchanger further includes two first headers 10 and 11 connected to respective upper ends of the first heat transfer pipe group 21*a* and the second heat transfer pipe group 21*b*, an intermediate header unit 18 having four second headers, and two third headers 16 and 17 connected to respective lower ends of the third heat transfer pipe group 21*c* and the fourth heat transfer pipe group 21*d*.

Two second headers 12 and 13 of the four second headers of the intermediate header unit 18 are connected to respective lower ends of the first heat transfer pipe group 21*a* and the second heat transfer pipe group 21*b*. The remaining two second headers 14 and 15 of the four second headers of the intermediate header unit 18 are connected to respective upper ends of the third heat transfer pipe group 21*c* and the fourth heat transfer pipe group 21*d*. Each of these headers is made up of a hollow component. One end of each of these headers is closed, and an after-mentioned inlet and outlet pipe or connecting pipe is connected to the other end of each of these headers.

Connected to negative sides (in FIG. 1, left sides) of first headers 19 and 20 in the second orientation are upper inlet and outlet pipes 110 and 111 serving as refrigerant inlets and outlets. Connected to negative sides of the third headers 16 and 17 in the second orientation are lower inlet and outlet pipes 116 and 117 serving as refrigerant inlets and outlets.

Figure 22:
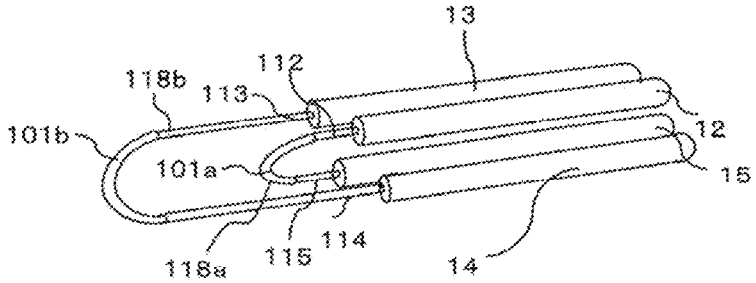
FIG. 22 is a schematic view of a configuration of pipes through which headers are connected to each other.

The intermediate header unit 18 has a communicating unit 118 through which the upper second headers 12 and 13 communicate with the lower second headers 14 and 15. As shown in FIG. 22, which will be described later, the communicating unit 118 has a first communicating pipe 118*a* one end of which is connected to the second header 12 and the other end of which is connected to the second header 15 and a second communicating pipe 118*b* one end of which is connected to the second header 13 and the other end of which is connected to the second header 14. The first communicating pipe 118*a* is connected by a connecting pipe 112, a U bend 101*a*, and a connecting pipe 115. The second communicating pipe 118*b* is made up of a connecting pipe 113, a U bend 101*b*, and a connecting pipe 114.

Thus, the communicating unit 118 allows the second headers 12 and 15 to communicate with each other and allows the second headers 13 and 14 to communicate with each other.

Both the first communicating pipe 118*a* and the second communicating pipe 118*b* are connected to the same side that is either a positive side (in FIG. 1, right side) or a negative side (in FIG. 1, left side) of the second orientation. In the example shown in FIG. 1, both the first communicating pipe 118*a* and the second communicating pipe 118*b* are connected to the negative side. This makes it possible to make flow passages between the upper second headers 12 and 13 and the lower second headers 14 and 15 shorter than in a case where the first communicating pipe 118*a* and the second communicating pipe 118*b* are connected separately to the positive and negative sides of the second orientation.

Moreover, the upper inlet and outlet pipes 110 and 111 and the lower inlet and outlet pipes 116 and 117 are connected to the negative side of the second orientation in the same way as the first communicating pipe 118*a* and the second communicating pipe 118*b*. This configuration causes the first headers 10 and 11 connected to an upper side of the first heat exchange unit 3*a* and the second headers 12 and 13 connected to a lower side of the first heat exchange unit 3*a* to be opposite in refrigerant flow direction to each other, although flows of refrigerant in the heat exchanger will be described in detail later. Similarly, this configuration causes the second headers 14 and 15 connected to an upper side of the second heat exchange unit 3*b* and the third headers 16 and 17 connected to a lower side of the second heat exchange unit 3*b* to be opposite in refrigerant flow direction to each other.

With the foregoing configuration, the heat exchanger has two independent refrigerant flow passages configured in parallel, and each flow of refrigerant has a windward flow passage portion and a leeward flow passage portion that are equal in length to each other. This increases heat exchanger efficiency by ensuring uniform temperature exchange between each refrigerant flow passage and air on both the windward side and the leeward side.

Figure 2:
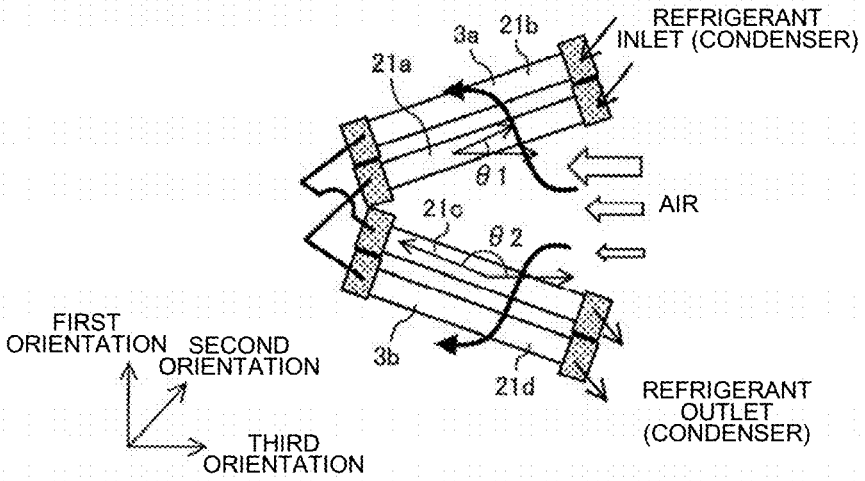
FIG. 2 is a schematic view of the heat exchanger according to Embodiment 1 of the present disclosure as seen from a side.

FIG. 2 is a schematic view of the heat exchanger according to Embodiment 1 of the present disclosure as seen from a side. In FIG. 2, the solid arrows indicate flows of refrigerant, and the outline arrows indicate flows of air. The same applies to the subsequent drawings. As shown in FIG. 2, the first heat exchange unit 3*a* satisfies 0 degree<θ1≤90 degrees, where θ1 is the angle of the first heat exchange unit 3*a* with respect to the third orientation. Further, the second heat exchange unit 3*b* satisfies 90 degrees≤θ2<180 degrees, where θ2 is the angle of the second heat exchange unit 3*b* relative to the third orientation. Note here that the angle of the first heat exchange unit relative to the third orientation is equivalent to an angle formed between the third orientation and a direction of extension of the heat transfer pipes of the first heat exchange unit.

In a case where the heat exchanger thus configured functions as a condenser, refrigerant flows through the first heat exchange unit 3*a* first and then the second heat exchange unit 3*b*. Moreover, in passing through the heat exchanger, gas refrigerant or two-phase gas-liquid refrigerant flows out in liquefied form while exchanging heat with air blown from a fan. In so doing, refrigerant of the first heat transfer pipe group 21*a* on the windward side of the heat exchange unit 3*a* flows into the fourth heat transfer pipe group 21*d* on the leeward side of the second heat exchange unit 3*b*. Further, refrigerant of the second heat transfer pipe group 21*b* on the leeward side of the first heat exchange unit 3*a* flows into the third heat transfer pipe group 21*c* on the windward side of the second heat exchange unit 3*b*.

Figure 3:
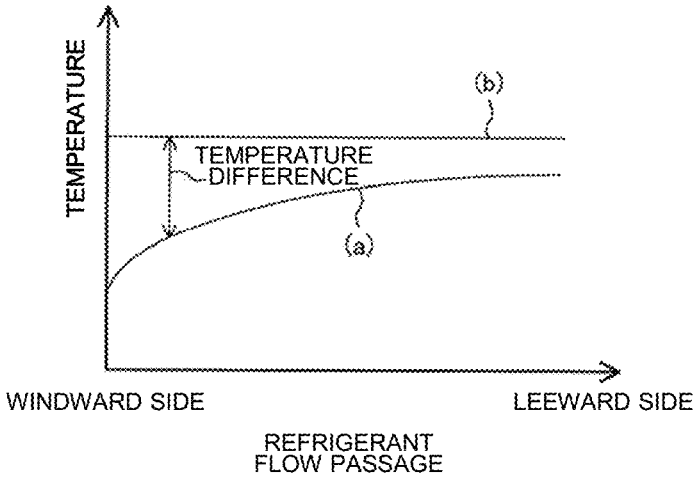
FIG. 3 is a graph showing a relationship between air and refrigerant that pass through the heat exchanger according to Embodiment 1 of the present disclosure.

FIG. 3 is a graph showing a relationship between air and refrigerant that pass through the heat exchanger according to Embodiment 1 of the present disclosure. FIG. 3 uses a line (a) to indicate changes in temperature of air in a case where the heat exchanger is used as a condenser. FIG. 3 uses a line (b) to indicate temperature in a case where the refrigerant is two-phase gas-liquid refrigerant. In FIG. 3, the horizontal axis represents refrigerant flow passages in the heat exchanger, and the vertical axis represents temperature.

Changes in temperature of air in the first heat exchange unit 3*a* and the second heat exchange unit 3*b* tend to be identical. Therefore, changes in temperature of air that passes through the first heat exchange unit 3*a* are described here.

As indicated by (a) in FIG. 3, the first heat transfer pipe group 21*a* on the windward side and the second heat transfer pipe group 21*b* on the leeward side are constant in temperature of refrigerant in a case where the refrigerant is two-phase gas-liquid refrigerant.

In a case where the heat exchanger functions as a condenser, air passes through the first heat transfer pipe group 21*a* on the windward side first and then the second heat transfer pipe group 21*b* on the leeward side, whereby the temperature of the air rises as indicated by (a) and comes close to the temperature of the refrigerant. Therefore, the difference in temperature between the air and the refrigerant becomes larger toward the windward side and smaller toward the leeward side. These variations in temperature difference enable the refrigerant to exchange a larger amount of heat on the windward side than on the leeward side.

Figure 4:
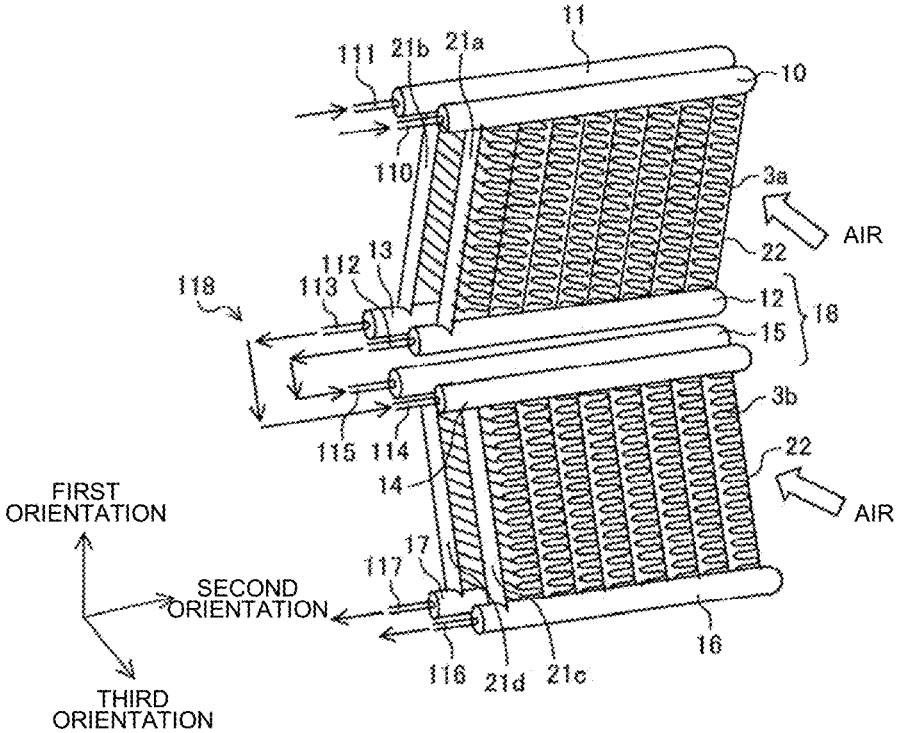
FIG. 4 is a perspective view representing in detail flows of refrigerant during use of the heat exchanger according to Embodiment 1 of the present disclosure as a condenser.

FIG. 4 is a perspective view representing in detail flows of refrigerant during use of the heat exchanger according to Embodiment 1 of the present disclosure as a condenser.

High-temperature and high-pressure gas refrigerant or two-phase gas-liquid refrigerant flows in through the upper inlet and outlet pipes 110 and 111 and reaches the first headers 10 and 11, respectively. Presuming that the flow of refrigerant having flowed into the first header 10 is a first flow and the flow of refrigerant having flowed into the first header 11 is a second flow, the following describes these flows.

(First Flow)

The refrigerant having flowed into the first header 10 flows in a positive direction of the second orientation through the first header 10 and flows into the first heat transfer pipe group 21*a* on the windward side in the first heat exchange unit 3*a*. Flows of refrigerant having passed through the first heat transfer pipe group 21*a* merge at the second header 12 into refrigerant that flows in a negative direction of the second orientation to flow out from the second header 12. The refrigerant having flowed out from the second header 12 flows in the positive direction of the second orientation into the second header 15 through the connecting pipe 112 first and then the connecting pipe 115.

The refrigerant having flowed into the second header 15 flows into the fourth heat transfer pipe group 21*d* on the leeward side in the second heat exchange unit 3*b*. Flows of refrigerant having passed through the fourth heat transfer pipe group 21*d* merge at the third header 17 into refrigerant that flows in the negative direction of the second orientation to flow out of the lower inlet and outlet pipe 117.

(Second Flow)

The refrigerant having flowed into the first header 11 flows in the negative direction of the second orientation through the first header 11 and flows into the second heat transfer pipe group 21*b* on the leeward side in the first heat exchange unit 3*a*. Flows of refrigerant having passed through the second heat transfer pipe group 21*b* merge at the second header 13 into refrigerant that flows in the negative direction of the second orientation to flow out from the second header 13. The refrigerant having flowed out from the second header 13 flows in the positive direction of the second orientation into the second header 14 through the connecting pipe 113 first and then the connecting pipe 114.

The refrigerant having flowed into the second header 14 flows into the third heat transfer pipe group 21*c* on the windward side in the second heat exchange unit 3*b*. Flows of refrigerant having passed through the third heat transfer pipe group 21*c* merge at the third header 16 into refrigerant that flows in the negative direction of the second orientation to flow out of the lower inlet and outlet pipe 116.

Note here that features of Embodiment 1 are divided into the following two features:

(1) In a case where the heat exchanger functions as a condenser, refrigerant flows downward.

(2) There are two parallel flows of refrigerant one of which is a first flow and the other one of which is a second flow, and flow passages are configured such that the first and second flows flow while refrigerant upstream and downstream sides of each of the first and second flows are swapping windward and leeward sides with each other.

Including the feature (1) causes the heat exchanger to, when functioning as a condenser, have no flow passage through which refrigerant flows in a direction opposite to the direction of gravitational force. This makes liquid refrigerant unable to defy gravity and thereby prevents it from staying in the intermediate header unit 18.

Further, including the feature (2) brings about the following effects. A heat exchanger of a comparative example is described here first. The heat exchanger does not particularly include the feature (2), and is conventionally configured such that in the process of an upward or downward flow of refrigerant, refrigerant upstream and downstream sides do not swap windward and leeward sides with each other.

Figure 5:
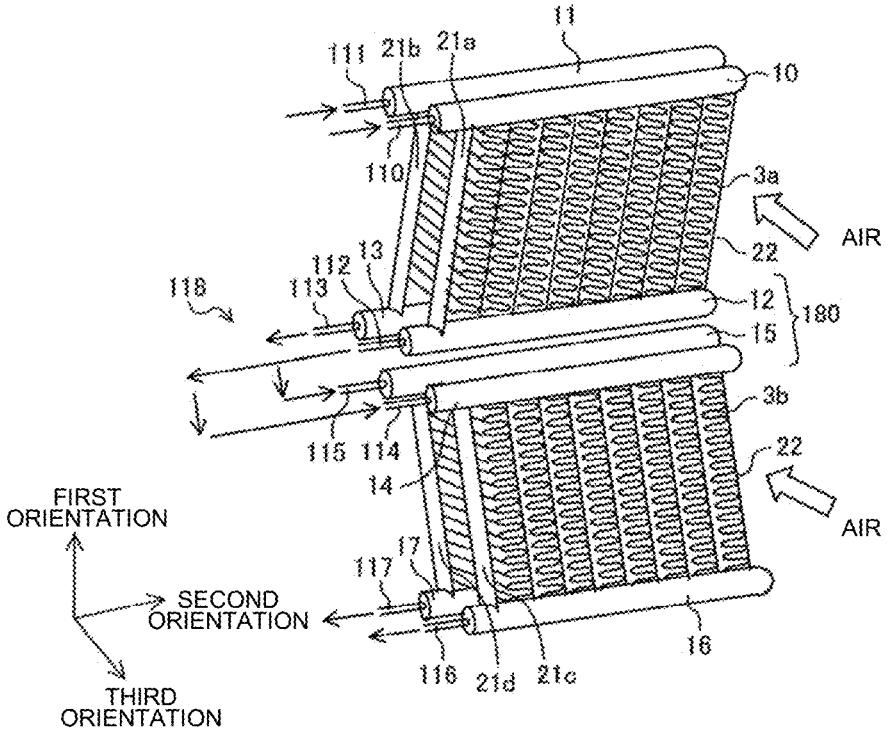
FIG. 5 is a diagram showing flows of refrigerant in a case where a heat exchanger of a comparative example functions as a condenser.
Figure 6:
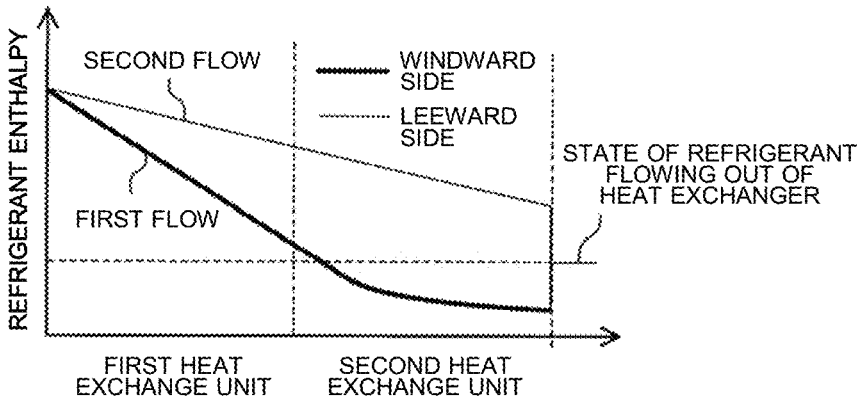
FIG. 6 is a graph showing an enthalpy state where first and second flows of refrigerant of the flows of refrigerant of FIG. 5 change as they proceed in flow directions.

FIG. 5 is a diagram showing flows of refrigerant in a case where the heat exchanger of the comparative example functions as a condenser. FIG. 6 is a graph showing an enthalpy state where first and second flows of refrigerant of the flows of refrigerant of FIG. 5 change as they proceed in flow directions.

As mentioned above, the heat exchanger of the comparative example shown in FIG. 5 has a flow passage configuration in which refrigerant upstream and downstream sides of each of the first and second flows do not swap windward and leeward sides with each other. That is, in this configuration, the second header 12 on the windward side and the windward second header 14 on the windward side communicate with each other through the intermediate header unit 180, and the second header 13 on the leeward side and the second header 15 on the leeward side communicate with each other through the intermediate header unit 180.

In the case of this configuration, the first flow is such that refrigerant having flowed into the first header 10 flows into the first heat transfer pipe group 21*a* on the windward side in the first heat exchange unit 3*a*. Flows of refrigerant having passed through the first heat transfer pipe group 21*a* merge at the second header 12 into refrigerant that flows into the second header 14 through the connecting pie 112 first and then the connecting pipe 114. The refrigerant having flowed into the second header 14 flows into the third heat transfer pipe group 21*c* on the windward in the second heat exchange unit 3*b*. Flows of refrigerant having passed through the third heat transfer pipe group 21*c* merge at the third header 16 into a flow that flows out of the lower inlet and outlet pipe 116.

Meanwhile, the second flow is such that refrigerant having flowed into the first header 11 flows into the second heat transfer pipe group 21*b* on the leeward side in the first heat exchange unit 3*a*. Flows of refrigerant having passed through the second heat transfer pipe group 21*b* merge at the second header 13 into refrigerant that flows into the second header 15 through the connecting pipe 113 first and then the connecting pipe 115. The refrigerant having flowed into the second header 15 flows into the fourth heat transfer pipe group 21*d* on the leeward side in the second heat exchange unit 3*b*. Flows of refrigerant having passed through the fourth heat transfer pipe group 21*d* merge at the third header 17 into a flow that flows out of the lower inlet and outlet pipe 117.

Having thus flowed, the first flow and the second flow differ from each other in terms of an enthalpy state of refrigerant flowing out of the heat exchanger, as shown in FIG. 6. The first flow, which continues to flow through the windward side, is smaller in refrigerant enthalpy than the second flow, which continues to flow through the leeward side.

As explained in FIG. 3 above, due to the flow through the windward side, the first flow greatly differs in temperature from the air, so that there is a great decrease in refrigerant enthalpy in the first heat exchange unit 3*a*. Moreover, by finishing exchanging heat with the air from a two-phase gas-liquid refrigerant state into a single-phase gas refrigerant state in the second heat exchange unit 3*b*, the first flow comes close in temperature to the air in the single-phase gas refrigerant state. This makes the first flow hardly able to cause a decrease in refrigerant enthalpy in the second heat exchange unit 3*b*. This makes a portion of the first flow hardly able to function in heat exchange, as a result, leading to deterioration in efficiency of the heat exchanger.

Further, as explained in FIG. 3 above, the second flow only slightly differs in temperature from the air by flowing through the leeward side, so that the enthalpy state of refrigerant having passed through the second heat exchange unit 3*b* is kept high. This causes the second flow to flow out of the heat exchanger without completely transferring to the air the amount of heat that the second flow has, leading as a result to insufficiency in the amount of heat that is given from the second flow of refrigerant to the air.

Thus, in the heat exchanger of the comparative example, one of the first and second flows continues to flow through the windward side, the other one of the first and second flows continues to flow through the leeward side. This causes refrigerant having passed through the first heat exchange unit 3*a* and the refrigerant having passed through the second heat exchange unit 3*b* to differ in enthalpy state from each other, causing an imbalance in heat exchange.

On the other hand, by including the feature (2), the heat exchanger of Embodiment 1 makes the first flow and the second flow capable of well-balanced heat exchange. A detailed description will be given below.

Figure 7:
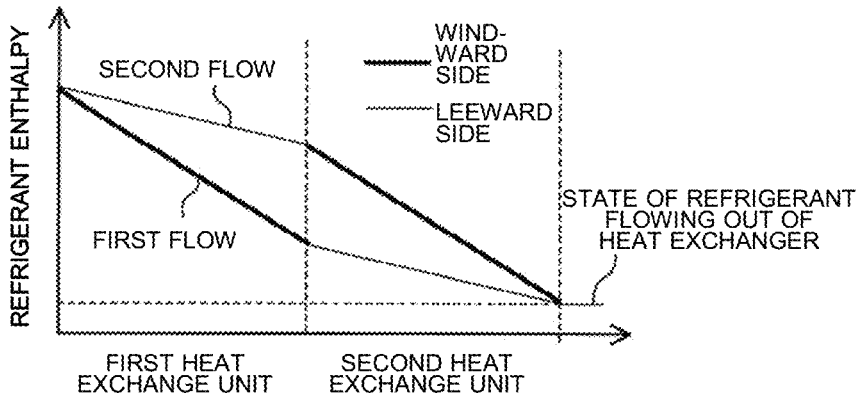
FIG. 7 is a graph showing an enthalpy state where first and second flows of refrigerant in a case where the heat exchanger according to Embodiment 1 of the present disclosure functions as a condenser change as they proceed in flow directions.

FIG. 7 is a graph showing an enthalpy state where first and second flows of refrigerant in a case where the heat exchanger according to Embodiment 1 of the present disclosure functions as a condenser change as they proceed in flow directions.

As shown in FIG. 7, the first flow flows through the windward side in the first heat exchange unit 3*a* and flows through the leeward side in the second heat exchange unit 3*b*. Further, the second flow flows through the leeward side in the first heat exchange unit 3*a* and flows through the windward side in the second heat exchange unit 3*b*. Moreover, a comparison between the first flow and the second flow in the first heat exchange unit 3*a* shows that the first flow, which flows through the windward side, is greater in temperature difference between the refrigerant and the air and therefore more greatly decreases in refrigerant enthalpy than the second flow, which flows through the leeward side. Meanwhile, a comparison between the first flow and the second flow in the second heat exchange unit 3*b* shows that the second flow, which flows through the windward side, is greater in temperature difference between the refrigerant and the air and therefore more greatly decreases in refrigerant enthalpy than the first flow, which flows through the leeward side.

Such changes in refrigerant enthalpy cause both the first flow of refrigerant and the second flow of refrigerant to be equal in enthalpy of refrigerant having passed through the heat exchanger, making it possible to carry out well-balanced heat exchange with the air.

Although Embodiment 1 has features in a case where the heat exchanger functions as a condenser, the following describes flows of refrigerant in a case where the heat exchanger functions as an evaporator.

Figure 8:
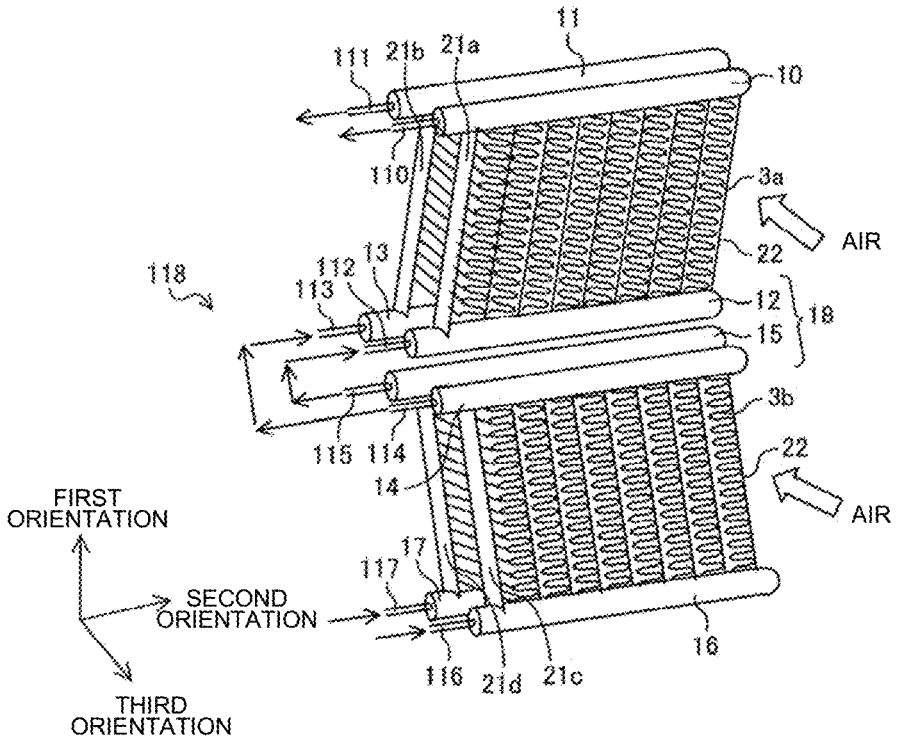
FIG. 8 is a perspective view representing flows of refrigerant during use of the heat exchanger according to Embodiment 1 of the present disclosure as an evaporator.

FIG. 8 is a perspective view representing flows of refrigerant during use of the heat exchanger according to Embodiment 1 of the present disclosure as an evaporator. In a case where the heat exchanger functions as an evaporator, two-phase gas-liquid refrigerant made up of a mixture of low-temperature and low-pressure gas refrigerant and liquid refrigerant flows in, becomes liquefied by exchanging heat with air in the process of flowing through the heat exchanger, and flows out as liquid refrigerant. A further specific description will be given below.

Two-phase gas-liquid refrigerants having flowed in through the lower inlet and outlet pipes 116 and 117 reach the third headers 16 and 17, respectively.

The refrigerant having flowed into the third header 16 flows into the third heat transfer pipe group 21*c* on the windward side in the second heat exchange unit 3*b*. Flows of refrigerant having passed through the third heat transfer pipe group 21*c* merge at the second header 14 into refrigerant that flows into the second header 13 through the connecting pipe 114 first and then the connecting pipe 113. The refrigerant having flowed into the second header 13 flows into the second heat transfer pipe group 21*b* on the leeward side in the first heat exchange unit 3*a*. Flows of refrigerant having passed through the second heat transfer pipe group 21*b* merge at the first header 11 into refrigerant that flows out of the upper inlet and outlet pipe 111.

The refrigerant having flowed into the third header 17 flows into the fourth heat transfer pipe group 21*d* on the leeward side in the second heat exchange unit 3*b*. Flows of refrigerant having passed through the fourth heat transfer pipe group 21*d* merge at the second header 15 into refrigerant that flows into the second header 12 through the connecting pipe 115 first and then the connecting pipe 112. The refrigerant having flowed into the second header 12 flows into the first heat transfer pipe group 21*a* on the windward side in the first heat exchange unit 3*a*. Flows of refrigerant having passed through the first heat transfer pipe group 21*a* merge at the first header 10 into refrigerant that flows out of the upper inlet and outlet pipe 110.

Liquid refrigerants are present in the second headers 12 and 13. Therefore, under the influence of gravity, flows of refrigerant that flow backward to the second headers 15 and 14 are generated in the second headers 12 and 13, respectively. However, subsequent flows of refrigerant that flow in from the second headers 15 and 14 are generated in the second headers 12 and 13, respectively. Therefore, the liquid refrigerants inside the second headers 12 and 13 are pushed out by the flows of refrigerant that flow in from the second headers 15 and 14, respectively. This causes the liquid refrigerants inside the second headers 12 and 13 to be sent to the first heat exchange unit 3*a* without staying in the second headers 12 and 13, respectively.

Further, in the second headers 14 and 15, flows of refrigerant that flow in from the third heat transfer pipe group 21*c* and the fourth heat transfer pipe group 21*d*, which are located below the second headers 14 and 15, are generated, respectively. Therefore, the liquid refrigerants inside the second headers 14 and 15 are pushed out by the flows of refrigerant that flow in from the third heat transfer pipe group 21*c* and the fourth heat transfer pipe group 21*d*, and are sent to the connecting pipes 114 and 115 without staying in the second headers 14 and 15, respectively.

As described above, Embodiment 1 is configured such that in a case where the heat exchanger functions as a condenser, refrigerant flows downward from an inlet to an outlet through the heat exchanger. This makes liquid refrigerant unable to defy gravity and thereby prevents it from staying in the heat exchanger. That is, the liquid refrigerant is discharged without staying in the heat exchanger. Further, since the liquid refrigerant does not stay in the heat exchanger, the liquid refrigerant can be inhibited from staying with refrigerating machine oil dissolved in the liquid refrigerant. An increase in the amount of refrigerating machine oil that is dissolved in the stagnant liquid refrigerant contributes to a decrease in the amount of refrigerating machine oil that returns to a refrigeration suction side of a compressor. This makes it necessary, as a result, to increase the amount of refrigerating machine oil that is charged for protection of the compressor from friction. However, Embodiment 1, which makes it possible to inhibit liquid refrigerant and refrigerating machine oil from staying, makes it possible to avoid excessive charging of refrigerant and refrigerating machine oil.

In Embodiment 1, there are two parallel flows of refrigerant, and each flow of refrigerant flows from the first heat exchange unit 3*a* to the second heat exchange unit 3*b* via the intermediate header unit 18. The intermediate header unit 18 is configured such that in a case where the heat exchanger functions as a condenser, at least a portion of refrigerant having flowed downward through the first heat transfer pipe group 21*a* and flowed out through the lower end of the first heat transfer pipe group 21*a* flows in through the upper end of the fourth heat transfer pipe group 21*d* and flows downward through the fourth heat transfer pipe group 21*d*. Further, the intermediate header unit 18 is configured such that at least a portion of refrigerant having flowed downward through the second heat transfer pipe group 21*b* and flowed out through the lower end of the second heat transfer pipe group 21*b* flows in through the upper end of the third heat transfer pipe group 21*c* and flows downward through the third heat transfer pipe group 21*c*.

That is, the heat exchanger has a flow passage configuration in which refrigerant upstream and downstream sides of each of the first and second flows, which flow through heat transfer pipe groups arranged in two rows, swap windward and leeward sides with each other. This makes it possible to ensure uniform heat exchange balance by using the first flow and the second flow to alternately carry out heat exchange involving a great difference in temperature between refrigerant and air and heat exchange involving a small difference in temperature between refrigerant and air. This makes it possible to improve heat exchanger performance.

Further, the heat exchanger of Embodiment 1 includes the first headers 10 and 11, the intermediate header unit 18, and the third headers 16 and 17. The intermediate header unit 18 includes the communicating unit 118, through which the upper second headers 12 and 13 communicate with the lower second headers 14 and 15. Thus, flow passages can be made up of the plurality of headers and the communicating unit 118.

The communicating unit 118 has the first communicating pipe 118*a* and the second communicating pipe 118*b*. One end of the first communicating pipe 118*a* is connected to the second header 12 at the lower end of the first heat transfer pipe group 21*a*, and the other end of the first communicating pipe 118*a* is connected to the second header 15 at the upper end of the fourth heat transfer pipe group. One end of the second communicating pipe 118*b* is connected to the second header 13 at the lower end of the second heat transfer pipe group 21*b*, and the other end of the second communicating pipe 118*b* is connected to the second header 14 at the upper end of the third heat transfer pipe group 21*c*. This makes it possible to configure flow passages such that refrigerant upstream and downstream sides of each of the first and second flows swap windward and leeward sides with each other.

Both the first communicating pipe 118*a* and the second communicating pipe 118*b* are connected to the same side, which is either the positive side or the negative side of the second orientation. In this example, both the first communicating pipe 118*a* and the second communicating pipe 118*b* are connected to the negative side. This makes it possible to make flow passages between the upper second headers 12 and 13 and the lower second headers 14 and 15 shorter than in a case where the first communicating pipe 118*a* and the second communicating pipe 118*b* are connected separately to the positive and negative sides of the second orientation.

The upper inlet and outlet pipes 110 and 111 and the lower inlet and outlet pipes 116 and 117 are connected to the negative side of the second orientation in the same way as the first communicating pipe 118*a* and the second communicating pipe 118*b*. This causes the first headers 10 and 11 connected to the upper side of the first heat exchange unit 3*a* and the second headers 12 and 13 connected to the lower side of the first heat exchange unit 3*a* to be opposite in refrigerant flow direction to each other. Similarly, this causes the second headers 14 and 15 connected to the upper side of the second heat exchange unit 3*b* and the third headers 16 and 17 connected to the lower side of the second heat exchange unit 3*b* to be opposite in refrigerant flow direction to each other.

Embodiment 2

Embodiment 2 differs from Embodiment 1 in respect of a flow direction of refrigerant through the intermediate header unit 18. The following describes Embodiment 2 with a focus on differences in configuration from Embodiment 1.

Figure 9:
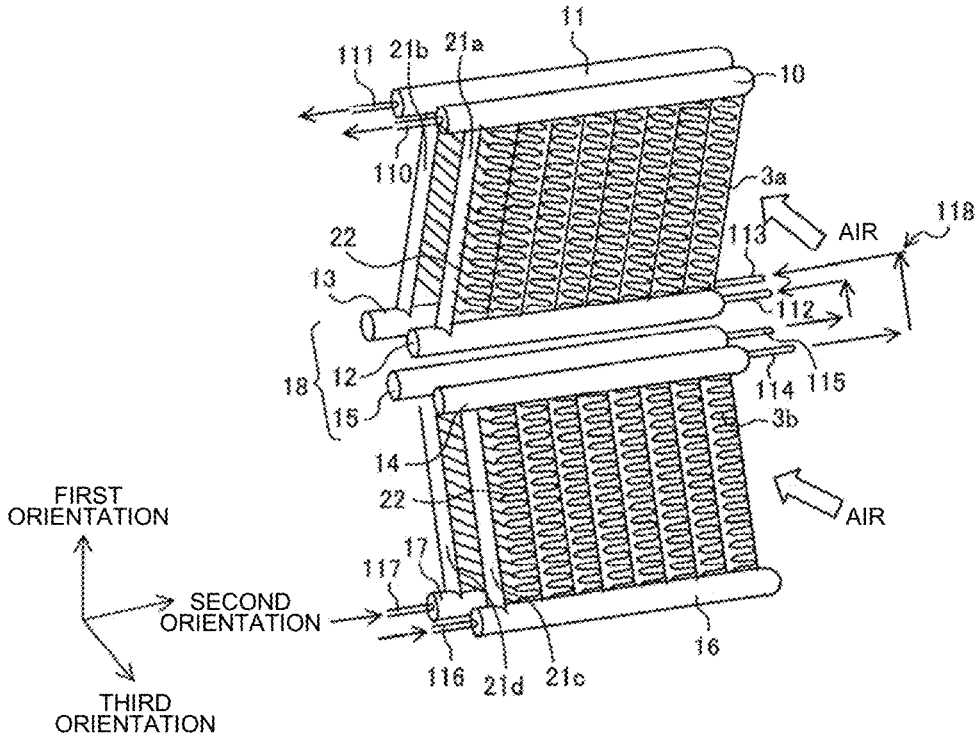
FIG. 9 is a front perspective view showing a heat exchanger according to Embodiment 2 of the present disclosure.

FIG. 9 is a front perspective view showing a heat exchanger according to Embodiment 2 of the present disclosure. FIG. 9 shows flows of refrigerant in a case where the heat exchanger functions as an evaporator.

The heat exchanger of Embodiment 2 is configured such that the connecting pipes 112 to 115, which are connected to the negative side of the second orientation in Embodiment 1, of the intermediate header unit 18 are connected to the positive side of the second orientation. That is, the heat exchanger of Embodiment 2 is configured such that the "connecting pipes 112 to 115 of the intermediate header unit 18" and the "upper inlet and outlet pipes 110 and 111 and the lower inlet and outlet pipes 116 and 117" are connected to opposite sides of the corresponding headers in the second orientation.

This configuration causes the first headers 10 and 11 connected to the upper side of the first heat exchange unit 3*a* and the second headers 12 and 13 connected to the lower side of the first heat exchange unit 3*a* to be identical in refrigerant flow direction to each other. Further, this configuration causes the second headers 14 and 15 connected to the upper side of the second heat exchange unit 3*b* and the third headers 16 and 17 connected to the lower side of the second heat exchange unit 3*b* to be identical in refrigerant flow direction to each other.

In a case where the heat exchanger thus configured functions as an evaporator, two-phase gas-liquid refrigerant made up of a mixture of low-temperature and low-pressure gas refrigerant and liquid refrigerant flows in through the lower inlet and outlet pipes 116 and 117 connected to the positive side of the second orientation and reaches the third headers 16 and 17.

The refrigerant having flowed into the third header 16 flows in the positive direction of the second orientation through the third header 16 and flows into the third heat transfer pipe group 21*c* on the windward side in the second heat exchange unit 3*b*. Flows of refrigerant having passed through the third heat transfer pipe group 21*c* merge at the second header 14 into refrigerant that flows in the positive direction of the second orientation to flow out from the second header 14. The refrigerant having flowed out from the second header 14 flows in the negative direction of the second orientation into the second header 13 through the connecting pipe 114 first and then the connecting pipe 113.

The refrigerant having flowed into the second header 13 flows into the second heat transfer pipe group 21*b* on the leeward side in the first heat exchange unit 3*a*. Flows of refrigerant having passed through the second heat transfer pipe group 21*b* merge at the first header 11 into refrigerant that flows in the negative direction of the second orientation to form a flow that flows out of the upper inlet and outlet pipe 111.

Meanwhile, the refrigerant having flowed into the third header 17 flows in the positive direction through the third header 17 and flows into the fourth heat transfer pipe group 21*d* on the leeward side in the second heat exchange unit 3*b*. Flows of refrigerant having passed through the fourth heat transfer pipe group 21*d* merge at the second header 15 into refrigerant that flows in the positive direction of the second orientation to flow out from the second header 15. The refrigerant having flowed out from the second header 15 flows in the negative direction of the second orientation into the second header 12 through the connecting pipe 115 first and then the connecting pipe 112.

The refrigerant having flowed into the second header 12 flows into the first heat transfer pipe group 21*a* on the windward side in the first heat exchange unit 3*a*. Flows of refrigerant having passed through the first heat transfer pipe group 21*a* merge at the first header 10 into refrigerant that flows in the negative direction of the second orientation to form a flow that flows out of the upper inlet and outlet pipe 110.

Figure 10:
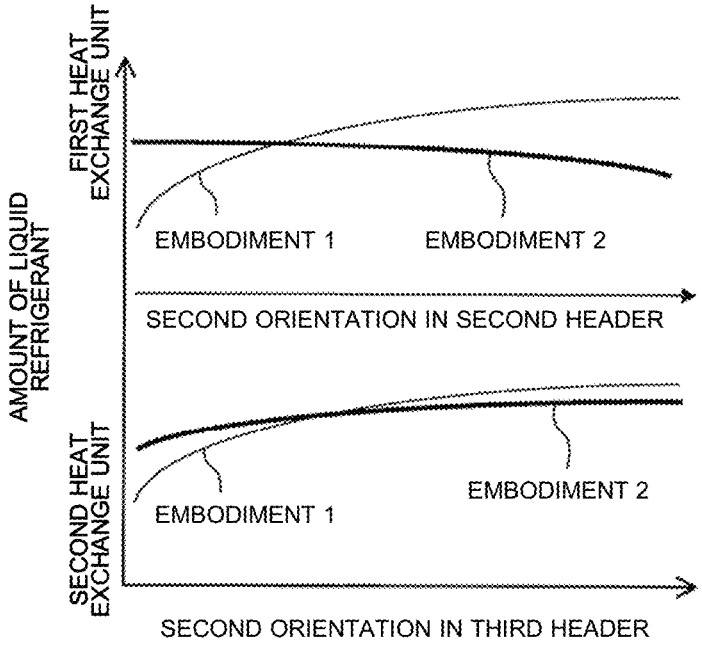
FIG. 10 is a graph showing a distribution of liquid refrigerant within the heat exchanger according to Embodiment 2 of the present disclosure in a case where the heat exchanger functions as an evaporator.

Next, effects of Embodiment 2 are described with reference to FIG. 10. FIG. 10 is a graph showing a distribution of liquid refrigerant within the heat exchanger according to Embodiment 2 of the present disclosure in a case where the heat exchanger functions as an evaporator. To clarify the differences between Embodiment 2 and Embodiment 1, FIG. 10 also shows a distribution of liquid refrigerant in Embodiment 1. In FIG. 10, the horizontal axis represents the positions of the second headers and the third headers in the second orientation, and the vertical axis represents the amount of liquid refrigerant.

Two-phase gas-liquid refrigerant flows in the positive direction of the second orientation into the third headers. For this reason, as shown in FIG. 10, much of the liquid refrigerant, which is high in density, contained in the two-phase gas-liquid refrigerant tends to be distributed in the positive direction (in FIG. 10, rightward) within the third headers by the force of inertia.

In the case of Embodiment 1, the headers on the upper side of the second heat exchange unit 3*b* and the headers on the lower side of the second heat exchange unit 3*b* are opposite in refrigerant flow direction to each other. Therefore, much of the gas refrigerant, which has a great pressure loss of refrigerant, is distributed in the negative direction of the second orientation of the third headers, so that flow passages are formed that lead by the most direct way to the connecting pipes 114 and 115 through the heat transfer pipe groups on the negative side of the second orientation in the second heat exchange unit 3*b*. This generates a flow that reduces the pressure loss of refrigerant.

On the other hand, in the case of Embodiment 2, the headers on the upper side of the second heat exchange unit 3*b* and the headers on the lower side of the second heat exchange unit 3*b* are identical in refrigerant flow direction to each other. This ensures uniformity in length of flow passages that lead into the third headers through the lower inlet and outlet pipes 116 and 117, pass through heat transfer pipes, and then reach the connecting pipes 114 and 115, respectively, no matter which heat transfer pipes the flow passages pass through. This makes it easy for the gas refrigerant flowing through the second heat exchange unit 3*b* to be uniformly distributed in the second orientation, and along with the uniform distribution of the gas refrigerant, the liquid refrigerant, much of which is one-sided in the positive direction of the second orientation, is stirred, with the result that the liquid refrigerant as well as the gas refrigerant is easily uniformly distributed in the second orientation.

Further, with an aim to bring about the same effects in the first heat exchange unit 3*a*, too, the headers on the upper side of the second heat exchange unit 3*b* and the headers on the lower side of the second heat exchange unit 3*b* are identical in refrigerant flow direction to each other. This makes it easy for the gas refrigerant and the liquid refrigerant to be uniformly distributed.

As described above, Embodiment 2 brings about the same effects as Embodiment 1 and brings about the following effects. That is, Embodiment 2 is configured such that the "connecting pipes 112 to 115 of the intermediate header unit 18" and the "upper inlet and outlet pipes 110 and 111 and the lower inlet and outlet pipes 116 and 117" are connected to opposite sides of the corresponding headers in the second orientation. This configuration causes the first headers 10 and 11 connected to the upper side of the first heat exchange unit 3*a* and the second headers 12 and 13 connected to the lower side of the first heat exchange unit 3*a* to be identical in refrigerant flow direction to each other. Further, this configuration causes the second headers 14 and 15 connected to the upper side of the second heat exchange unit 3*b* and the third headers 16 and 17 connected to the lower side of the second heat exchange unit 3*b* to be identical in refrigerant flow direction to each other.

This makes it easy for the liquid refrigerant flowing through the heat exchanger to be uniformly distributed in a case where the heat exchanger functions as an evaporator, making it possible, as a result, to make the heat exchanger higher in heat exchange efficiency than Embodiment 1.

Further, as with Embodiment 1, Embodiment 2 is configured such that in a case where the heat exchanger functions as a condenser, refrigerant that liquefies flows downward through a flow passage. This prevents the liquid refrigerant and refrigerating machine oil dissolved in the liquid refrigerant from staying in the heat exchanger, making it possible to avoid excessive charging of refrigerant and refrigerating machine oil.

Embodiment 3

Embodiment 3 differs from Embodiment 1 in respect of a configuration of the intermediate header unit 18. The following describes Embodiment 3 with a focus putting on differences in configuration from Embodiment 1.

Figure 11:
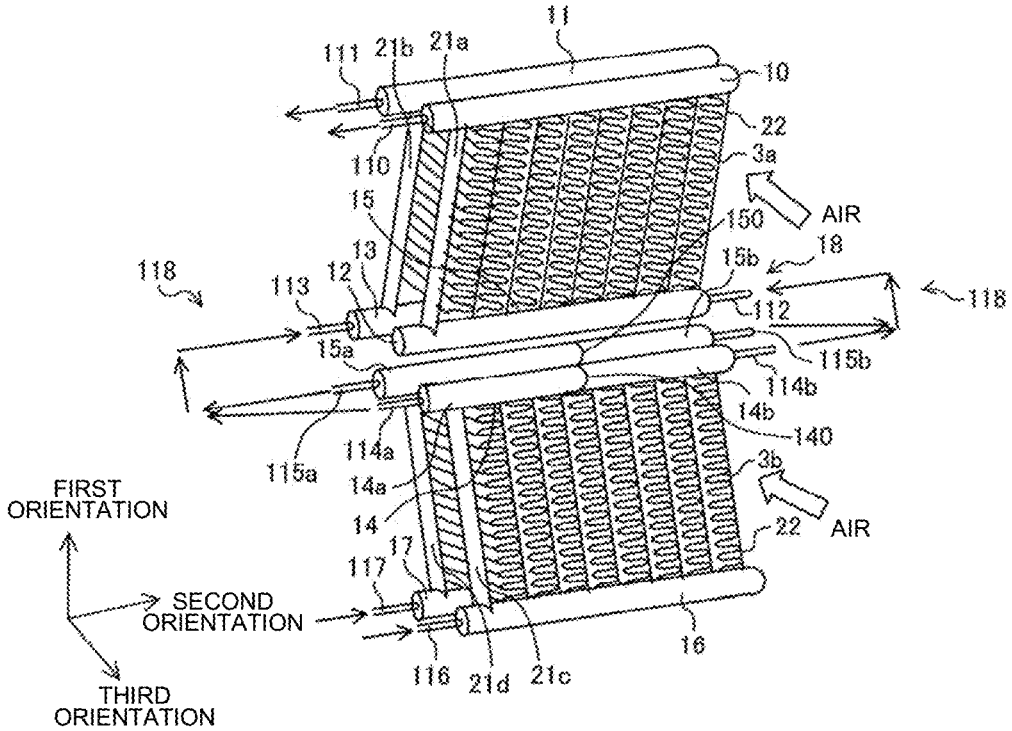
FIG. 11 is a front perspective view showing a heat exchanger according to Embodiment 3 of the present disclosure.

FIG. 11 is a front perspective view showing a heat exchanger according to Embodiment 3 of the present disclosure. FIG. 11 shows flows of refrigerant in a case where the heat exchanger functions as an evaporator.

The heat exchanger of Embodiment 3 is configured such that the interiors of the second headers 14 and 15 of the intermediate header unit 18 are divided by dividers 140 and 150 at the center of the second orientation, respectively. Such division leads to the formation of a negative-side header 14*a* and a positive-side header 14*b* in the second header 14 and the formation of a negative-side header 15*a* and a positive-side header 15*b* in the second header 15.

Figure 23:
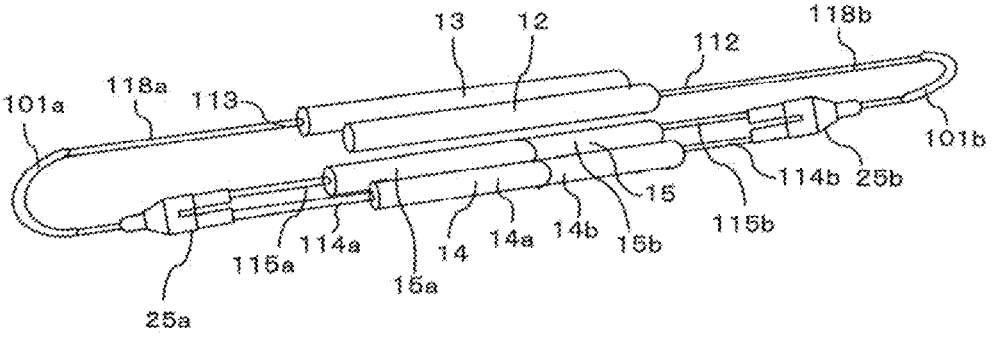
FIG. 23 is a schematic view of another configuration of pipes through which headers are connected to each other.

Further, the intermediate header unit 18 has a communicating unit 118 through which the upper second headers 12 and 13 communicate with the lower second headers 14 and 15. As shown in FIG. 23, which will be described later, the communicating unit 118 has a first communicating pipe 118*a* and a second communicating pipe 118*b*. One end of the second communicating pipe 118*b* is connected to the second header 12, and the other end of the second communicating pipe 118*b* is bifurcated to be connected to the positive-side headers 14*b* and 15*b*. Specifically, the second communicating pipe 118*b* is made up of a connecting pipe 112, a U bend 101*b*, a bifurcated pipe 25, a connecting pipe 114*b*, and a connecting pipe 115*b*. One end of the first communicating pipe 118*a* is connected to the second header 13, and the other end of the first communicating pipe 118*a* is bifurcated to be connected to the negative-side headers 14*a* and 15*a*. Specifically, the first communicating pipe 118*a* is made up of a connecting pipe 112, a U bend 101*b*, a bifurcated pipe 25, a connecting pipe 114*a*, and a connecting pipe 115*a*.

In a case where the heat exchanger thus configured functions as an evaporator, two-phase gas-liquid refrigerant made up of a mixture of low-temperature and low-pressure gas refrigerant and liquid refrigerant flows in through the lower inlet and outlet pipes 116 and 117 disposed on the negative side of the second orientation and reaches the third headers 16 and 17, respectively.

The refrigerant having flowed into the third header 16 flows into the third heat transfer pipe group 21*c* on the windward side in the second heat exchange unit 3*b*. Flows of refrigerant having passed through the third heat transfer pipe group 21*c* flow into the two divisions, namely the negative-side and positive-side headers 14*a* and 14*b*, of the second header 14.

Meanwhile, the refrigerant having flowed into the third header 17 flows into the fourth heat transfer pipe group 21*d* on the leeward side in the second heat exchange unit 3*b*. Flows of refrigerant having passed through the fourth heat transfer pipe group 21*d* flow into the two divisions, namely the negative-side and positive-side headers 15*a* and 15*b*, of the second header 15.

The refrigerant of the negative-side header 14*a* and the refrigerant of the negative-side header 15*a* merge after having flowed out from the connecting pipes 114*a* and 115*a*, respectively. Then, the merged refrigerant flows into the connecting pipe 113 and then flows into the second header 13. The refrigerant having flowed into the second header 13 flows into the second heat transfer pipe group 21*b*. Flows of refrigerant having passed through the second heat transfer pipe group 21*b* merge at the first header 11 into a flow that flows out from the upper inlet and outlet pipe 110.

Meanwhile, the refrigerant of the positive-side header 14*b* and the refrigerant of the positive-side header 15*b* merge after having flowed out from the connecting pipes 114*b* and 115*b*, respectively. Then, the merged refrigerant flows into the connecting pipe 112 and then flows into the second header 12. The refrigerant having flowed into the second header 12 flows into the first heat transfer pipe group 21*a*. Flows of refrigerant having passed through the first heat transfer pipe group 21*a* merge at the first header 10 into a flow that flows out from the upper inlet and outlet pipe 110.

Figure 12:
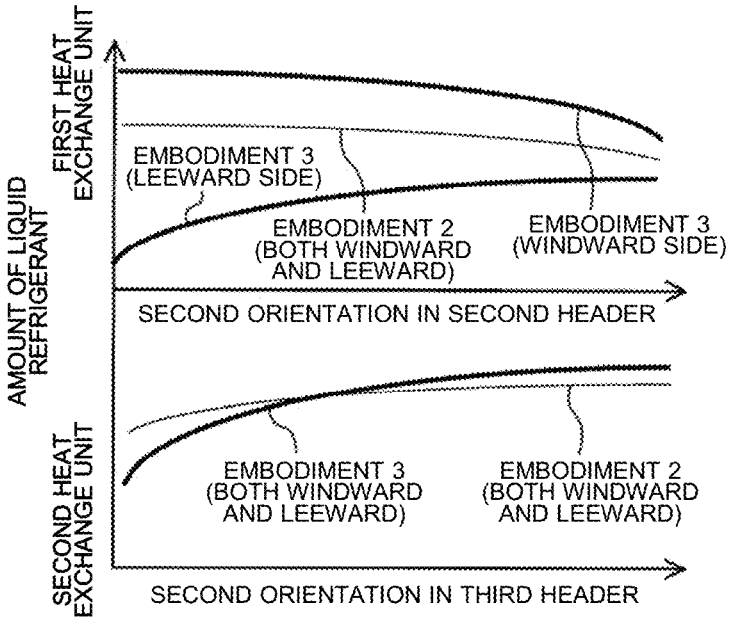
FIG. 12 is a graph showing a distribution of liquid refrigerant within the heat exchanger according to Embodiment 3 of the present disclosure in a case where the heat exchanger functions as an evaporator.

Next, effects of Embodiment 3 are described with reference to FIG. 12. FIG. 12 is a graph showing a distribution of liquid refrigerant within the heat exchanger according to Embodiment 3 of the present disclosure in a case where the heat exchanger functions as an evaporator. To clarify the differences between Embodiment 3 and Embodiment 2, FIG. 12 also shows a distribution of liquid refrigerant in Embodiment 2. In FIG. 12, the horizontal axis represents the positions of the second headers and the third headers in the second orientation, and the vertical axis represents the amount of liquid refrigerant.

As shown in FIG. 12, much of the liquid refrigerant, which is high in density, contained in the two-phase gas-liquid refrigerant flowing into the third headers tends to be distributed in the positive direction of the second orientation by the force of inertia. With this distribution kept, the refrigerant flows from the third headers through the second heat exchange unit 3*b* into the second headers. For this reason, in the second headers, much of the liquid refrigerant tends to be distributed in the position direction of the second orientation.

As shown in FIG. 11, the interiors of the second headers 14 and 15 are divided by the dividers 140 and 150 into two parts at the center of the second orientation in the aforementioned manner. Therefore, a large amount of liquid refrigerant is distributed in the positive-side headers 14*b* and 15*b*, which are located on the positive side of the second orientation, and a large amount of gas refrigerant is distributed in the negative-side headers 14*a* and 15*a*, which are located on the negative side of the second orientation.

The liquid refrigerant of the positive-side headers 14*b* and 15*b*, in which a large amount of liquid refrigerant is distributed, flows into the first heat transfer pipe group 21*a* after having been supplied to the second header 12 on the windward side of the first heat exchange unit 3*a* through the connecting pipes 114*b*, 115*b*, and 112.

Thus, a large amount of liquid refrigerant flows into the first heat transfer pipe group 21*a* of the windward side. Moreover, the large amount of liquid refrigerant having flowed into the first heat transfer pipe group 21*a* on the windward side greatly differs in temperature from air and therefore can sufficiently exchange heat with air in the first heat transfer pipe group 21*a*.

Meanwhile, the refrigerant in the negative-side headers 14*a* and 15*a*, in which a large amount of gas refrigerant is distributed with a small amount of liquid refrigerant, flows into the second heat transfer pipe group 21*b* after having been supplied to the second header 13 on the leeward side of the first heat exchange unit 3*a* through the connecting pipes 114*a*, 115*a*, and 113.

The small amount of liquid refrigerant flowing into the second heat transfer pipe group 21*b* only slightly differs in temperature from air and therefore does not completely evaporate in the middle of the second heat transfer pipe group 21*b*. This makes it possible to carry out efficient heat exchange.

Furthermore, since the liquid refrigerant flows in the negative direction of the second orientation into the second header 12, much of the liquid refrigerant tends to be distributed in the negative direction of the second orientation within the second header 12. Since the refrigerant flows into the first heat transfer pipe group 21*a* with this distribution kept, more of the liquid refrigerant is distributed to heat transfer pipes of the first heat transfer pipe group 21*a* located on the negative side than to heat transfer pipes of the first heat transfer pipe group 21*a* located on the positive side. Meanwhile, since the liquid refrigerant flows in the positive direction of the second orientation into the second header 13, much of the liquid refrigerant tends to be distributed in the positive direction of the second orientation within the second header 13. Since the refrigerant flows into the second heat transfer pipe group 21*b* with this distribution kept, more of the liquid refrigerant is distributed to heat transfer pipes of the second heat transfer pipe group 21*b* located on the positive side than to heat transfer pipes of the second heat transfer pipe group 21*b* located on the negative side.

Therefore, air flowing into a positive-side area of the first heat exchange unit 3*a* in the second orientation undergoes a small temperature change by exchanging heat with a smaller amount of liquid refrigerant in the first heat transfer pipe group 21*a* on the windward side than on the negative side of the second orientation. Moreover, air having flowed into the second heat transfer pipe group 21*b* on the leeward side exchanges heat with a "larger amount of liquid refrigerant" than on the negative side of the second orientation. In this case, even with heat exchange carried out with a "large amount of liquid refrigerant" in the second heat transfer pipe group 21*b*, the "large amount of liquid refrigerant" can carry out necessary heat exchange on the leeward side of the first heat exchange unit 3*a*, as there is a great difference in temperature between the air and the liquid refrigerant.

Further, air flowing into a negative-side area of the first heat exchange unit 3*a* in the second orientation undergoes a great temperature change by exchanging heat with a larger amount of liquid refrigerant in the first heat transfer pipe group 21*a* on the windward side than on the positive side of the second orientation. Moreover, air having flowed into the second heat transfer pipe group 21*b* on the leeward side exchanges heat with a "smaller amount of liquid refrigerant" than on the negative side of the second orientation. In this case, because of heat exchange with a "small amount of liquid refrigerant" in the second heat transfer pipe group 21*b*, the "small amount of liquid refrigerant" can carry out necessary heat exchange on the leeward side of the first heat exchange unit 3*a*, even with a small difference in temperature between the air and the liquid refrigerant.

As described above, Embodiment 3 brings about the same effects as Embodiment 1 and brings about the following effects. In Embodiment 3, the interiors of the second headers 14 and 15 are divided at the center of the second orientation, whereby the positive-side and negative-side headers 14*b* and 14*a* and the positive-side and negative-side headers 15*b* and 15*a* are formed. The communicating unit 118 has the first communicating pipe 118*a* and the second communicating pipe 118*b*. One end of the first communicating pipe 118*a* is connected to the second header 12, and the other end of the first communicating pipe 118*a* is bifurcated to be connected to the positive-side headers 14*b* and 15*b*. One end of the second communicating pipe 118*b* is connected to the second header 13, and the other end of the second communicating pipe 118*b* is bifurcated to be connected to the negative-side headers 14*a* and 15*a*. This configuration makes it possible to achieve a well-balanced distribution of the liquid refrigerant to the positive-side and negative-side areas in the first heat exchange unit 3*a* in the second orientation, making it possible to carry out efficient heat exchange.

Further, Embodiment 3 is configured such that in a case where the heat exchanger functions as an evaporator, a large amount of liquid refrigerant flows through the windward side in the heat exchanger, and a small amount of liquid refrigerant flows through the leeward side in the heat exchanger. This makes it possible to distribute refrigerant according to a difference in temperature between air and liquid refrigerant. This makes it possible, as a result, to make the heat exchanger higher in heat exchange efficiency than Embodiment 2. Further, as with Embodiment 2, Embodiment 3 is configured such that in a case where the heat exchanger is used as a condenser, refrigerant that liquefies flows downward through a flow passage. This prevents the liquid refrigerant and refrigerating machine oil dissolved in the liquid refrigerant from staying in the heat exchanger, making it possible to avoid excessive charging of refrigerant and refrigerating machine oil.

Embodiment 4

Embodiment 4 relates to a configuration in which the heat exchanger is divided into a plurality of heat exchangers. Further, Embodiment 4 describes a case where the heat exchanger functions as a condenser.

In the configuration in which the heat exchanger is divided into a plurality of heat exchangers, there are a plurality of patterns of flow of refrigerant in a case where the heat exchanger is used as a condenser. The following describes each pattern.

(Pattern 1)

Figure 13:
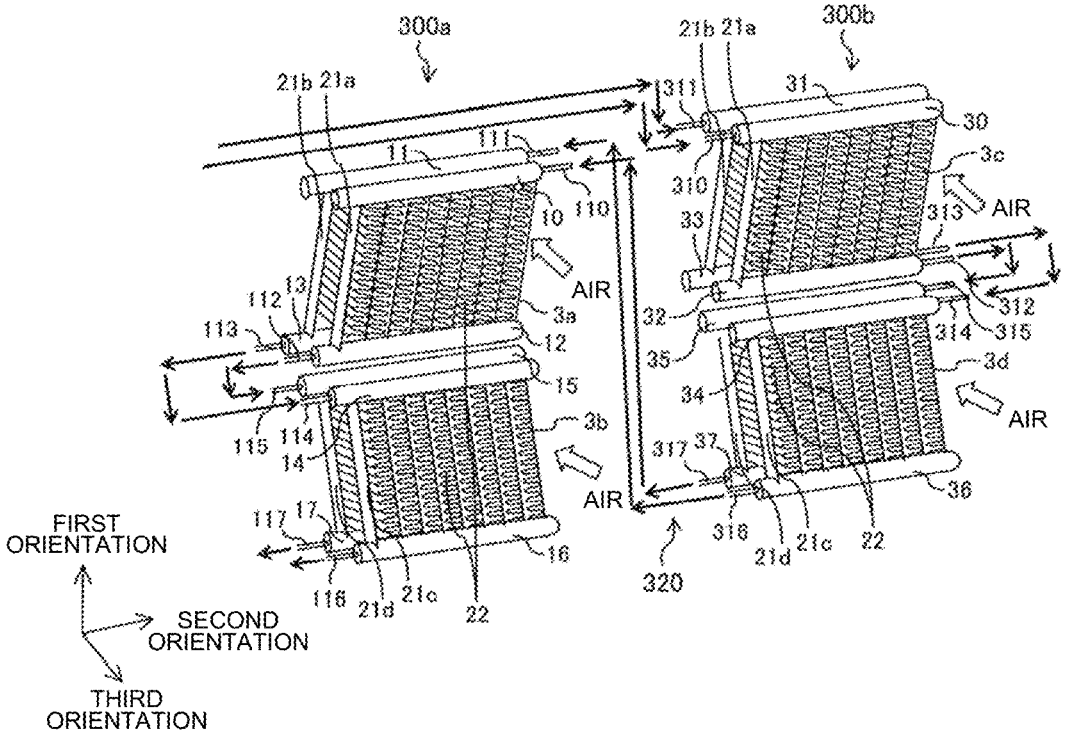
FIG. 13 is a perspective view showing flows of refrigerant in a heat exchanger of Pattern 1 according to Embodiment 4 of the present disclosure.

FIG. 13 is a perspective view showing flows of refrigerant in a heat exchanger of Pattern 1 according to Embodiment 4 of the present disclosure.

The heat exchanger of Embodiment 4 is divided into two parts in the second orientation, whereby a positive-side heat exchanger 300*b* and a negative-side heat exchanger 300*a* are formed. The positive-side heat exchanger 300*b* and the negative-side heat exchanger 300*a* are connected in series through a connecting unit 320. The heat exchanger of Embodiment 4 includes this configuration throughout Patterns 2 to 4, which will be described below, as well as Pattern 1.

Moreover, the heat exchanger of Pattern 1 has a configuration in which the heat exchanger of Embodiment 2 shown in FIG. 9, that is, a heat exchanger in which upper and lower headers of a heat exchange unit are identical in refrigerant flow direction to each other, is divided into two heat exchangers in the second orientation. Further, the heat exchanger of Pattern 1 has a configuration in which two flows of refrigerant flow at the connection between the positive-side heat exchanger 300*b* and the negative-side heat exchanger 300*a*.

In FIG. 13, components of the negative-side heat exchanger 300*a* on the refrigerant downstream side are given the same signs as those used in FIG. 2. The positive-side heat exchanger 300*a* on the refrigerant upstream side is given new signs as appropriate. The positive-side heat exchanger 300*b* on the refrigerant upstream side has a first heat exchange unit 3*c* located upward in the direction of gravitational force and a second heat exchange unit 3*d* located downward in the direction of gravitational force. As with the first heat exchange unit 3*a*, the first heat exchange unit 3*c* extends in a direction at the angle θ1. As with the second heat exchange unit 3*b*, the second heat exchange unit 3*d* extends in a direction at the angle θ2.

The following describes flows of refrigerant in a case where the heat exchanger of FIG. 13 functions as a condenser.

High-temperature and high-pressure gas refrigerant or two-phase gas-liquid refrigerant flows in through inlet and outlet pipes 310 and 311 and reaches first headers 30 and 31, respectively. The following assumes that the flow of refrigerant having flowed into the first header 30 is a first flow and the flow of refrigerant having flowed into the first header 31 is a second flow.

(First Flow)

The refrigerant having flowed into the first header 30 flows into the first heat transfer pipe group 21*a* on the windward side in the first heat exchange unit 3*c*. Flows of refrigerant having passed through the first heat transfer pipe group 21*a* merge at a second header 32 into refrigerant that flows into a second header 35 through a connecting pipe 312 first and then a connecting pipe 315. The refrigerant having flowed into the second header 35 flows into the fourth heat transfer pipe group 21*d* on the leeward side in the second heat exchange unit 3*d*. Flows of refrigerant having passed through the fourth heat transfer pipe group 21*d* merge at a third header 37 into refrigerant that reaches the first header 11 through the upper inlet and outlet pipe 111 from a connecting pipe 317.

As in the case of Embodiment 2, the refrigerant having flowed into the first header 11 forms a flow that flows out via the second heat transfer pipe group 21*b* on the leeward side in the first heat exchange unit 3*a*, the second header 13, the connecting pipe 113, the connecting pipe 114, the second header 14, the third heat transfer pipe group 21*c* on the windward side in the second heat exchange unit 3*b*, the third header 16, and the lower inlet and outlet pipe 116.

(Second Flow)

The refrigerant having flowed into the first header 31 flows into the second heat transfer pipe group 21*b* on the leeward side in the first heat exchange unit 3*c*. Flows of refrigerant having passed through the second heat transfer pipe group 21*b* merge at a second header 33 into refrigerant that flows into a second header 34 through a connecting pipe 313 first and then a connecting pipe 314. The refrigerant having flowed into the second header 34 flows into the third heat transfer pipe group 21*c* on the windward side in the second heat exchange unit 3*d*. Flows of refrigerant having passed through the third heat transfer pipe group 21*c* merge at a third header 36 into refrigerant that reaches the first header 10 through the upper inlet and outlet pipe 110 from a connecting pipe 316.

As in the case of Embodiment 2, the refrigerant having flowed into the first header 10 forms a flow that flows out via the first heat transfer pipe group 21*a* on the windward side in the first heat exchange unit 3*a*, the second header 12, the connecting pipe 112, the connecting pipe 115, the second header 15, the fourth heat transfer pipe group 21*d* on the leeward side in the second heat exchange unit 3*b*, the third header 17, and the lower inlet and outlet pipe 117.

The foregoing configuration makes it possible to bring about the same effects as Embodiment 2 even in a case where the heat exchanger is long in the second orientation and needs to be divided for convenience in manufacturing. Alternatively, the configuration of Embodiment 1 or 3 may be used to configure a heat exchanger divided in the second orientation, although FIG. 13 is illustrated by using Embodiment 2 as an example. Alternatively, Embodiments 1 to 3 may be combined to configure a heat exchanger divided in the second orientation.

(Pattern 2)

Figure 14:
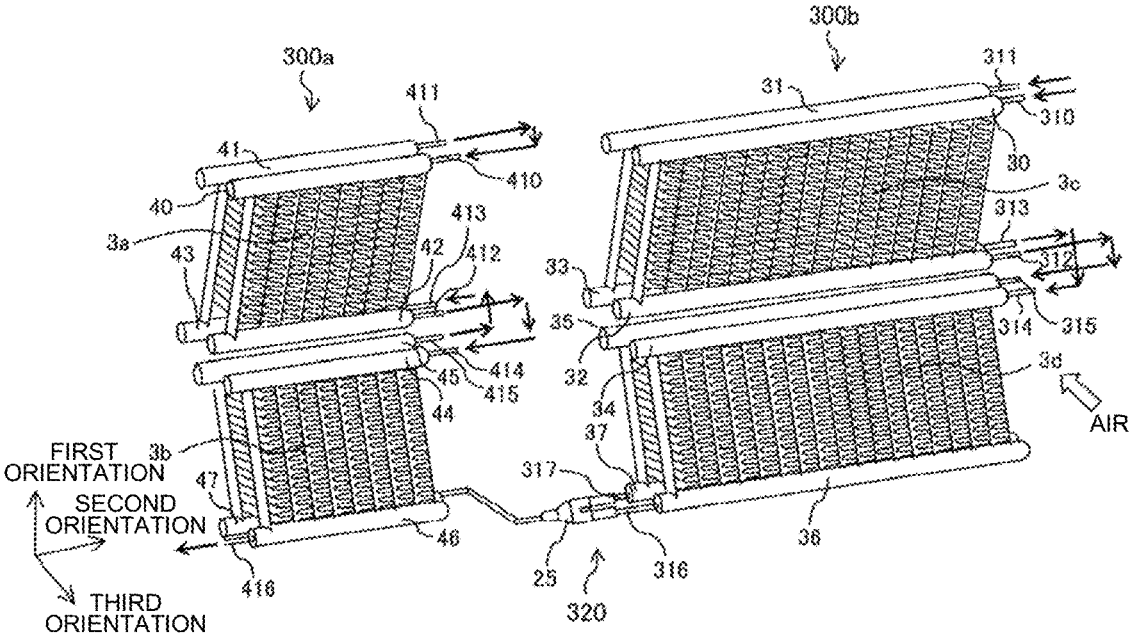
FIG. 14 is a perspective view showing flows of refrigerant in a heat exchanger of Pattern 2 according to Embodiment 4 of the present disclosure.

FIG. 14 is a perspective view showing flows of refrigerant in a heat exchanger of Pattern 2 according to Embodiment 4 of the present disclosure.

The heat exchanger of Pattern 2 has a configuration in which the heat exchanger of Embodiment 1 shown in FIG. 4 is divided into two serially-connected parts in the second orientation and two flows of refrigerant converge into one flow of refrigerant at the serial connection. Further, the heat exchanger of Pattern 2 applies Embodiment 1 to the first heat exchange unit 3*c* and applies Embodiment 2 to the second heat exchange unit 3*d*. That is, upper and lower headers of the first heat exchange unit 3*c* are opposite in refrigerant flow direction to each other. Further, upper and lower headers of the second heat exchange unit 3*d* are opposite in refrigerant flow direction to each other.

Moreover, as in the case of Embodiment 1, the positive-side heat exchanger 300*b* is configured such that the second headers 32 and 33 and the second headers 34 and 35 are connected to each other so that refrigerant that flowed on the windward side in the first heat exchange unit 3*c* flows through the leeward side in the second heat exchange unit 3*d* and refrigerant that flowed on the leeward side in the first heat exchange unit 3*c* flows through the windward side in the second heat exchange unit 3*d*. However, as in the case of a related-art heat exchanger, the negative-side heat exchanger 300*a* applies a configuration in which in the process of an upward or downward flow of refrigerant, a flow that passes through the windward side and a flow that passes through the leeward side do not interchange.

The following describes flows of refrigerant in a case where the heat exchanger of FIG. 14 functions as a condenser. Flows of refrigerant in the positive-side heat exchanger 300*b* are the same as flows of refrigerant in the positive-side heat exchanger 300*b* of FIG. 13 except that the direction of inflow of refrigerant into the first headers 30 and 31 is opposite to the direction of inflow of refrigerant into the first headers 30 and 31 of FIG. 13. Moreover, flows of refrigerant having flowed out from the connecting pipes 316 and 317 of the positive-side heat exchanger 300*b* merge at a bifurcated pipe 25 into refrigerant that reaches a third header 47 of the negative-side heat exchanger 300*a*.

The refrigerant having passed through the third header 47 flows out of an inlet and outlet pipe 416 through the leeward side of the second heat exchange unit 3*b*, a second header 45, a second header 43, the leeward side of the first heat exchange unit 3*a*, a first header 41, a connecting pipe 411, a connecting pipe 410, a first header 40, the windward side of the first heat exchange unit 3*a*, the windward side of the second heat exchange unit 3*b*, and a third header 46.

Note here that in Pattern 2, the positive-side heat exchanger 300*b*, which is situated upstream of a refrigerant flow passage, is twice or more as large in capacity as the negative-side heat exchanger 300*a*, which is situated downstream of the refrigerant flow passage, so that the refrigerant flows into the negative-side heat exchanger 300*a* in a single-phase liquid state. For this reason, the negative-side heat exchanger 300*a* is used for the purpose of providing subcooling for single-phase liquid refrigerant.

(Modification of Pattern 2)

Figure 15:
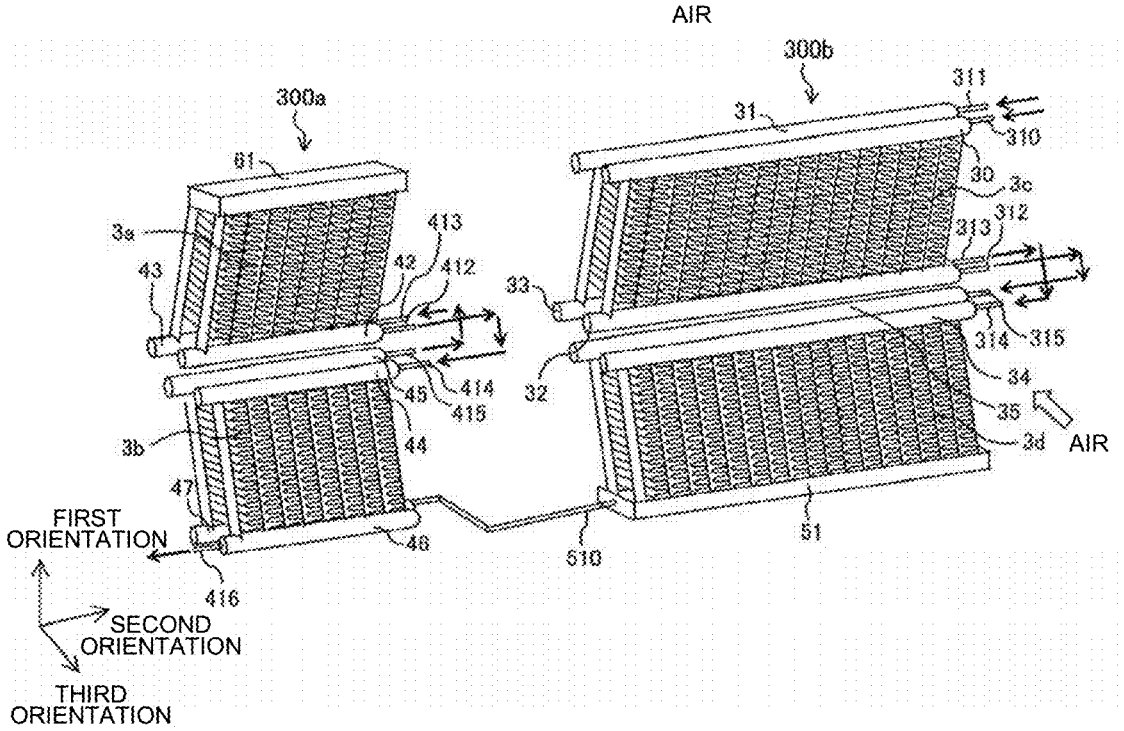
FIG. 15 is a diagram showing a modification of the heat exchanger of FIG. 14.

FIG. 15 is a diagram showing a modification of the heat exchanger of FIG. 14.

As shown in FIG. 15, a header 51 may be used instead of the third headers 36 and 37 of FIG. 14. Further, a header 61 may be used instead of the first headers 40 and 41 of FIG. 14. Further, a connecting pipe 510 may be used instead of the connecting pipes 316 and 317 of FIG. 14 and the bifurcated pipe 25 of FIG. 14. The headers 51 and 61 are configured as below as shown in FIGS. 16 and 17, respectively.

Figure 16:
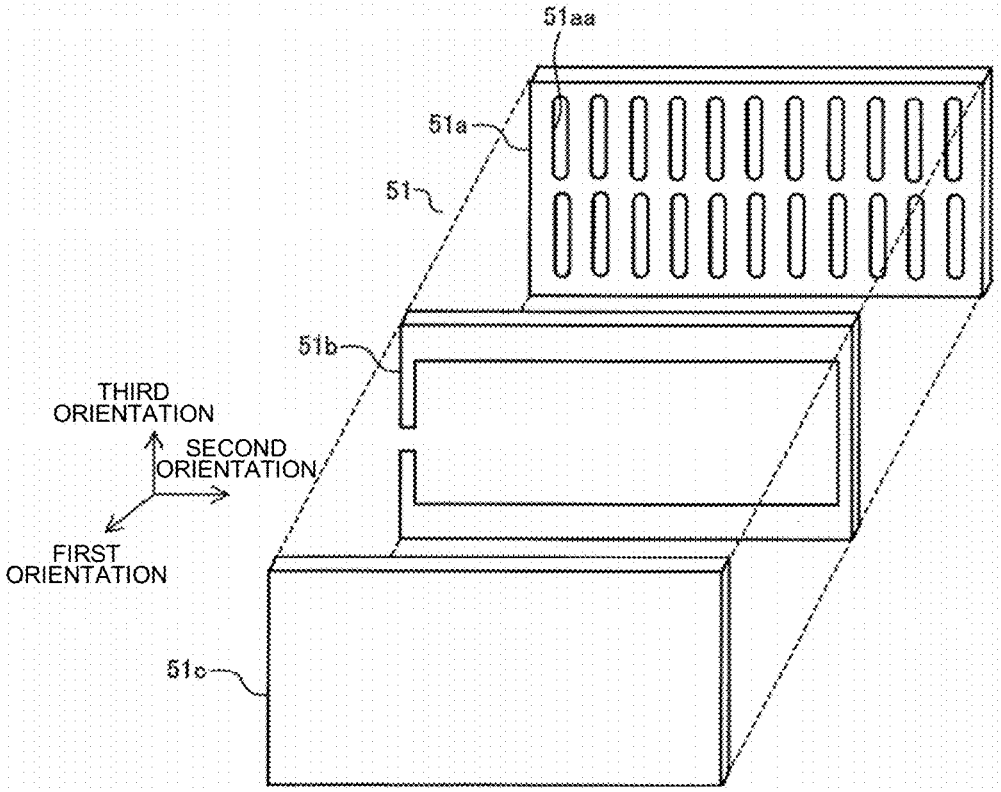
FIG. 16 is a block diagram of a header 51 of FIG. 15.

FIG. 16 is a block diagram of the header 51 of FIG. 15. FIG. 17 is a block diagram of the header 61 of FIG. 15.

As shown in FIG. 16, the header 51 has a header plate 51*a* having formed therein a plurality of insertion holes 51*aa* into which flat heat transfer pipes are inserted, a frame plate 51*b*, and a header cover 51*c*. The header 51 functions to cause flows of refrigerant having flowed out from a windward-side heat transfer pipe group of the second heat exchange unit 3*d* and a leeward-side heat transfer pipe group of the second heat exchange unit 3*d* to merge into refrigerant that flows to the connecting pipe 510.

Figure 17:
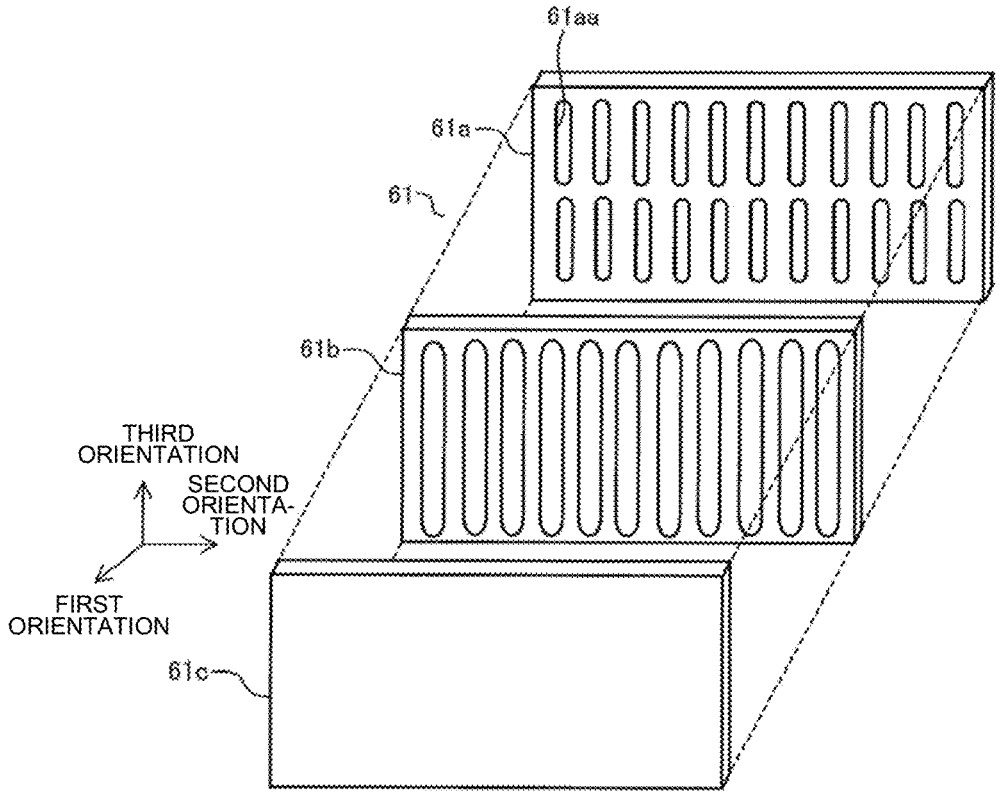
FIG. 17 is a block diagram of a header 61 of FIG. 15.

As shown in FIG. 17, the header 61 has a header plate 61*a* having formed therein a plurality of insertion holes 61*aa* into which flat heat transfer pipes are inserted, a drift prevention plate 61*b*, and a header cover 61*c*. The header 61 functions to cause refrigerant having passed through the leeward-side heat transfer pipe group of the first heat exchange unit 3*a* to flow to the windward-side heat transfer pipe group of the first heat exchange unit 3*a*.

Incidentally, in the configuration of Pattern 2 shown in FIGS. 14 and 15, refrigerant rises in a part of a flow passage in the negative-side heat exchanger 300*a* in a case where the heat exchanger functions as a condenser, as in the case of a conventional heat exchanger. That is, an upward flow is generated. For this reason, in the case of an upward flow of two-phase refrigerant, such concern is raised that liquid refrigerant may stay in the third header 47. However, in a case where single-phase liquid refrigerant flows into the negative-side heat exchanger 300*a*, the third header 47 is filled with liquid refrigerant without affecting the state of the refrigerant in the third header 47 no matter whether an upward flow or a downward flow is generated in a flow passage situated downstream of the third header 47 along the refrigerant flow.

Thus, once the third header 47 is filled with liquid refrigerant, a heat transfer pipe group of the negative-side heat exchanger 300*a* is filled with liquid refrigerant, too. That is, in a case where single-phase liquid refrigerant flows into the negative-side heat exchanger 300*a*, no such inconvenience occurs that liquid refrigerant stays without flowing, even if an upward flow is generated downstream of the third header 47 along the refrigerant flow. Therefore, it can be said that a configuration that does not require an excessive amount of refrigerant can be achieved by applying the configurations of Embodiments 1 to 3 to the positive-side heat exchanger 300*b*.

(Pattern 3)

Figure 18:
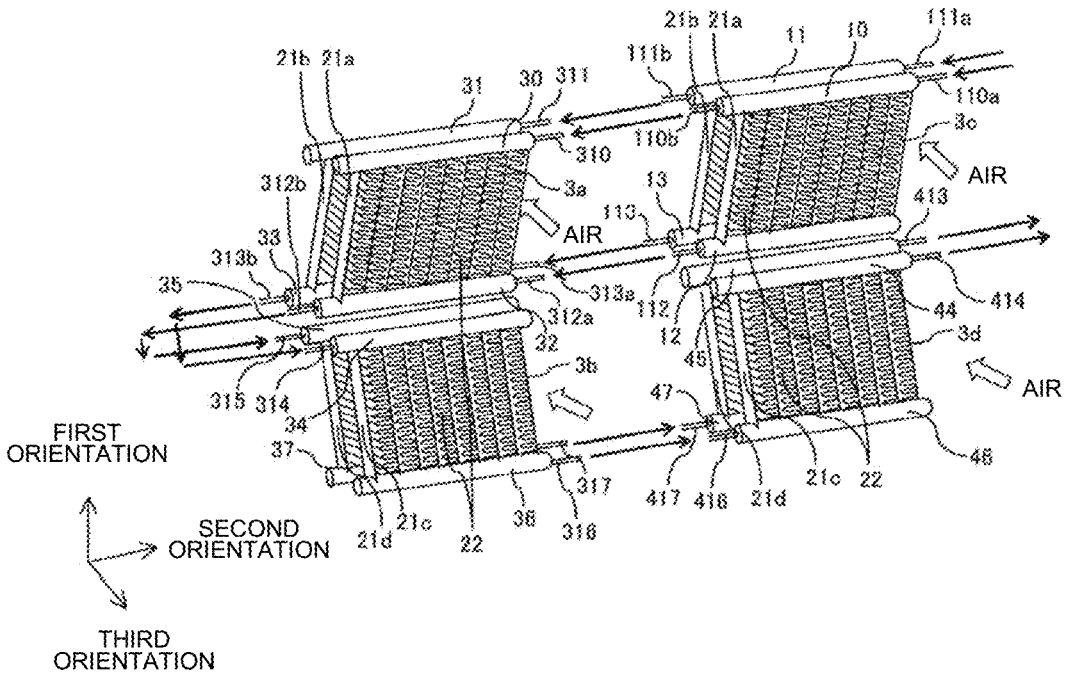
FIG. 18 is a perspective view showing flows of refrigerant in a heat exchanger of Pattern 3 according to Embodiment 4 of the present disclosure.

FIG. 18 is a perspective view showing flows of refrigerant in a heat exchanger of Pattern 3 according to Embodiment 4 of the present disclosure.

The heat exchanger of Pattern 3 is configured such that the first heat exchange unit 3*a* of Embodiment 1 shown in FIG. 1 is elongated in the second orientation and divided into two parts in the second orientation, whereby a first heat exchange unit 3*a*, a first heat exchange unit 3*c*, and a second heat exchange unit 3*b* are formed. Further, the heat exchanger of Pattern 3 has a second heat exchange unit 3*d* in which refrigerant forms an upward flow in a case where the heat exchanger functions as a condenser as in the case of a conventional heat exchanger. Thus, the heat exchanger of Pattern 3 is a combination of a configuration in which the heat exchanger of Embodiment 1 is divided and a related-art heat exchanger.

(Modification of Pattern 3)

Figure 19:
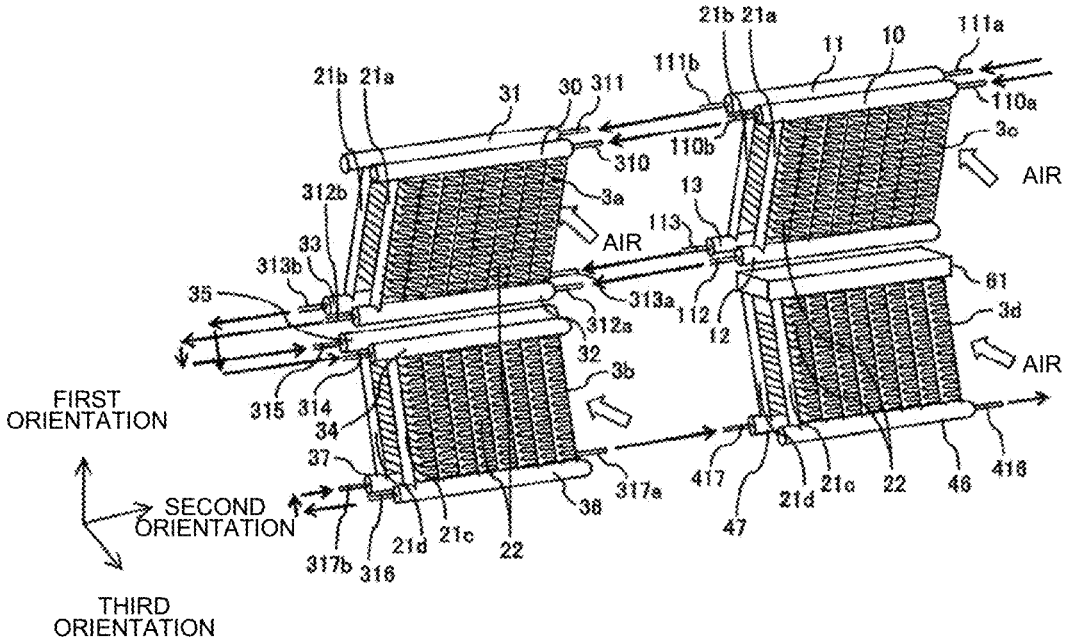
FIG. 19 is a diagram showing a modification of the heat exchanger of FIG. 18.

FIG. 19 is a diagram showing a modification of the heat exchanger of FIG. 18.

The second heat exchange unit 3*d* of FIG. 18 described above is configured such that refrigerant forms parallel flows on the windward side and the leeward side. On the other hand, in this modification, a conventional heat exchanger configured such that refrigerant forms a counterflow that flows from the windward side to the leeward side is used as the second heat exchange unit 3*d*.

(Pattern 4)

Figure 20:
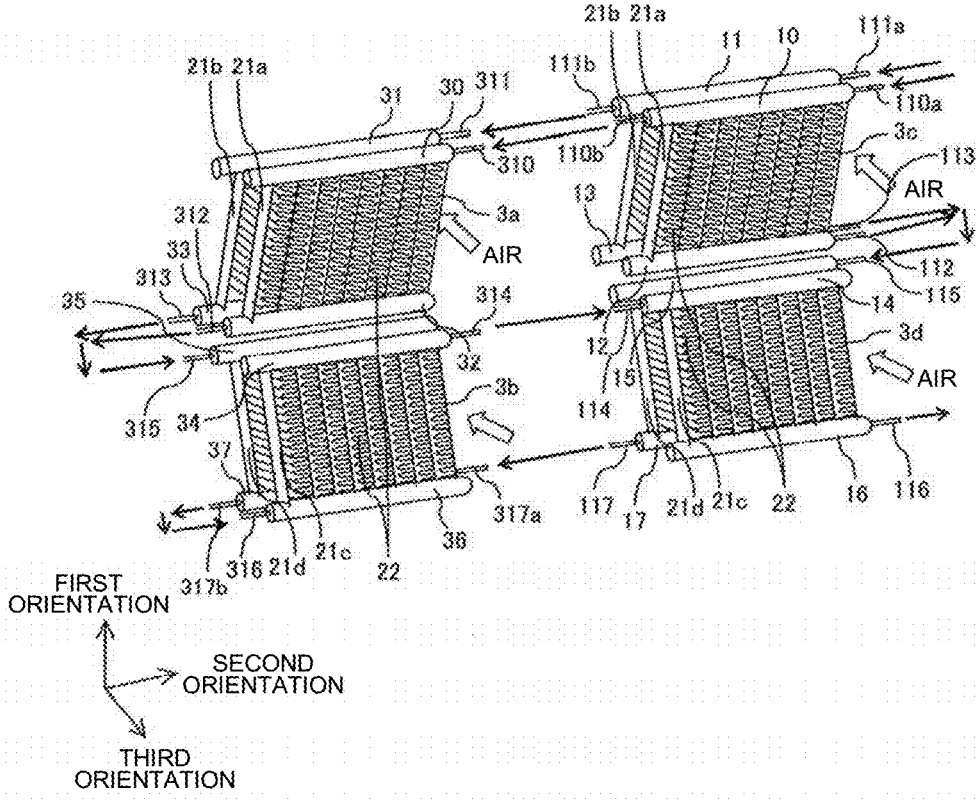
FIG. 20 is a perspective view showing flows of refrigerant in a heat exchanger of Pattern 4 according to Embodiment 4 of the present disclosure.

FIG. 20 is a perspective view showing flows of refrigerant in a heat exchanger of Pattern 4 according to Embodiment 4 of the present disclosure.

In the heat exchanger of Pattern 4, flows of refrigerant having passed through the first heat exchange units 3*a* and 3*c* merge after having passed through the leeward sides of the second heat exchange units 3*b* and 3*d*, respectively. Then, the confluent refrigerant passes through the windward side of the second heat exchange unit 3*b* first and then the windward side of the second heat exchange unit 3*d*.

In this configuration, refrigerant having flowed through the first heat transfer pipe groups 21*a* on the windward sides of the first heat exchange units 3*a* and 3*c* flows to the fourth heat transfer pipe groups 21*d* on the leeward sides of the second heat exchange units 3*b* and 3*d*. That is, in this configuration, refrigerant upstream and downstream sides have swapped windward and leeward sides with each other. However, on the leeward sides of the first heat exchange units 3*a* and 3*c*, refrigerant having flowed through the second heat transfer pipe groups 21*b* flow to the fourth heat transfer groups 21*d* on the leeward sides of the second heat exchange units 3*b* and 3*d*. For this reason, refrigerant upstream and downstream sides have not swapped windward and leeward sides with each other. However, refrigerant upstream and downstream sides of at least either refrigerant flowing into the heat exchanger through an upper inlet and outlet pipe 110*a* or refrigerant flowing into the heat exchanger through an upper inlet and outlet pipe 110*b* have swapped windward and leeward sides with each other. This configuration makes it possible to bring about improvement in heat exchange performance by ensuring uniform heat exchange balance.

(Modification of Pattern 4)

Figure 21:
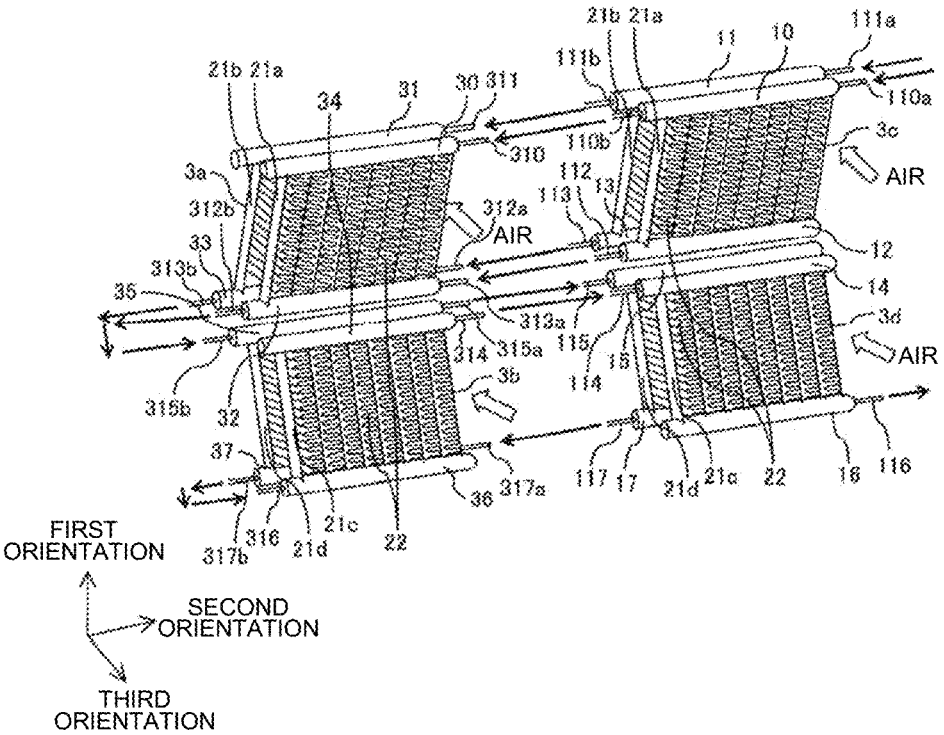
FIG. 21 is a diagram showing a modification of the heat exchanger of FIG. 20.

FIG. 21 is a diagram showing a modification of the heat exchanger of FIG. 20.

In the configuration of FIG. 20, refrigerant having flowed out from the second headers 12 and 13 and refrigerant having flowed out from the second headers 32 and 33 flow in parallel into the leeward side of the second heat exchange unit 3*b* and the leeward side of heat exchange unit 3*d*. On the other hand, in this modification, refrigerant having flowed out from the second headers 12 and 13 flows into the second headers 32 and 33. Then, flows of refrigerant having flowed out from the second headers 32 and 33 merge into refrigerant that flows into the second header 35.

The refrigerant having flowed into the second header 35 is divided into refrigerant that flows toward the second header 15 and refrigerant that flows toward the fourth heat transfer pipe group 21*d* on the leeward side of the second heat exchange unit 3*b*. The refrigerant having flowed toward the second header 15 passes through the third header 17 after having passed through the leeward side of the second heat exchange unit 3*d*, and then merges at the third header 37 with the refrigerant having passed through the fourth heat transfer pipe group 21*d* directly from the second header 35. As in the case of FIG. 20, the flow of refrigerant having passed through the third header 37 passes through the windward side of the second heat exchange unit 3*b* first and then the windward side of the heat exchange unit 3*d*.

As in the case of FIGS. 14 and 15, an upward flow of refrigerant is generated in a part of each of the configurations of FIGS. 18 to 21. However, in each of the configurations of FIGS. 18 to 20, a flow passage of refrigerant situated downstream of a part where an upward flow is generated is filled with refrigerant assuming a liquid refrigerant state. Specifically, the second heat exchange units 3*d* of FIGS. 18 and 19 and the windward sides of the second heat exchange units 3*b* and 3*d* of FIGS. 20 and 21 are filled with refrigerant flowing therethrough in a liquid refrigerant state. For this reason, in a header involved in such a heat exchanger filled with liquid refrigerant, the amount of refrigerant that stays does not depend on the flow direction of refrigerant such as an upward flow or a downward flow.

Accordingly, it can be said that in each of the configurations of FIGS. 18 and 19, a configuration that does not require an excessive amount of refrigerant can be achieved by applying the configurations of Embodiments 1 to 3 to the first heat exchange unit 3*a*, the first heat exchange unit 3*c*, and the second heat exchange unit 3*b*. Further, it can be said that a configuration that does not require an excessive amount of refrigerant can be achieved by applying the configurations of Embodiments 1 to 3 to the first heat exchange units 3*a*, the first heat exchange units 3*c*, and the leeward sides of the second heat exchange units 3*b* and 3*d* of FIGS. 20 and 21.

For the reasons noted above, in a case where a heat exchanger is divided into two heat exchangers in the second orientation, Embodiment 4 makes it possible to improve heat exchanger performance by applying a configuration in which the configurations of Embodiments 1 to 3 are applied to one or both of the two heat exchangers. Further, in the process of liquefaction of single-phase gas or two-phase liquid-gas refrigerant, the formation of a flow passage that extends downward in a vertical direction prevents liquid refrigerant and refrigerating machine oil dissolved in the liquid refrigerant from staying in the heat exchanger. This makes it possible to reduce excessive charging of refrigerant and refrigerating machine oil.

Next, specific example configurations of pipes through which headers are connected to each other in Embodiments 1 to 4 are described.

FIG. 22 is a schematic view of a configuration of pipes through which headers are connected to each other.

In FIG. 22, the headers are connected to each other using U bends 101*a* and 101*b*. The configuration of FIG. 22 is applied to the connections between the second headers of FIGS. 4, 5, 7, 9, and 13 to 15 in particular.

FIG. 23 is a schematic view of another configuration of pipes through which headers are connected to each other.

In FIG. 23, the headers are connected to each other using the U bends 101*a* and 101*b* and bifurcated pipes 25*a* and 25*b*. The configuration of FIG. 23 is applied to the connections between the second headers of FIGS. 11, 20, and 21 in particular.

Figure 24:
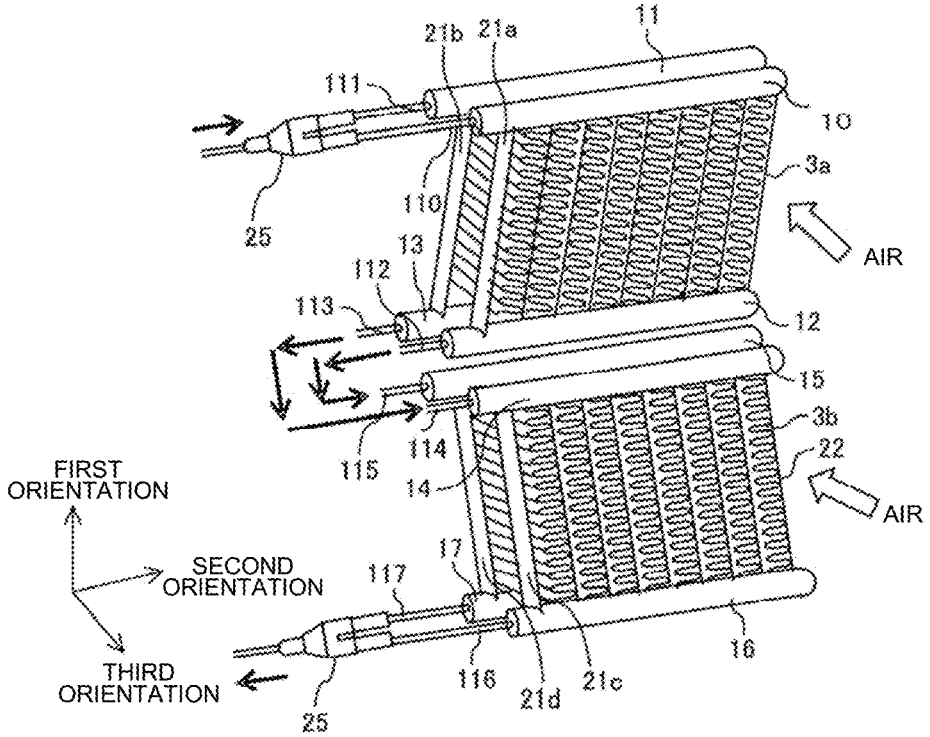
FIG. 24 is a schematic view of a configuration of pipes at places where refrigerant flows into and out of the heat exchanger.

FIG. 24 is a schematic view of a configuration of pipes at places where refrigerant flows into and out of the heat exchanger. In this example, the configuration of pipes of FIG. 24 is applied to Embodiment 1 shown in FIG. 4, although it is applied to all of Embodiments 1 to 4.

In each of Embodiments 1 to 4, there are two places in the heat exchange through which refrigerant flows in, and there are two places in the heat exchanger through which refrigerant flows out. In FIG. 24, a bifurcated pipe 25 is used at the places through which refrigerant flows in, and a bifurcated pipe 25 is used at the places through which refrigerant flows out.

Embodiment 5

Embodiment 5 relates to a refrigeration cycle device including the heat exchanger of any of Embodiments 1 to 4. An air-conditioning device is described here as an example of the refrigeration cycle device.

Figure 25:
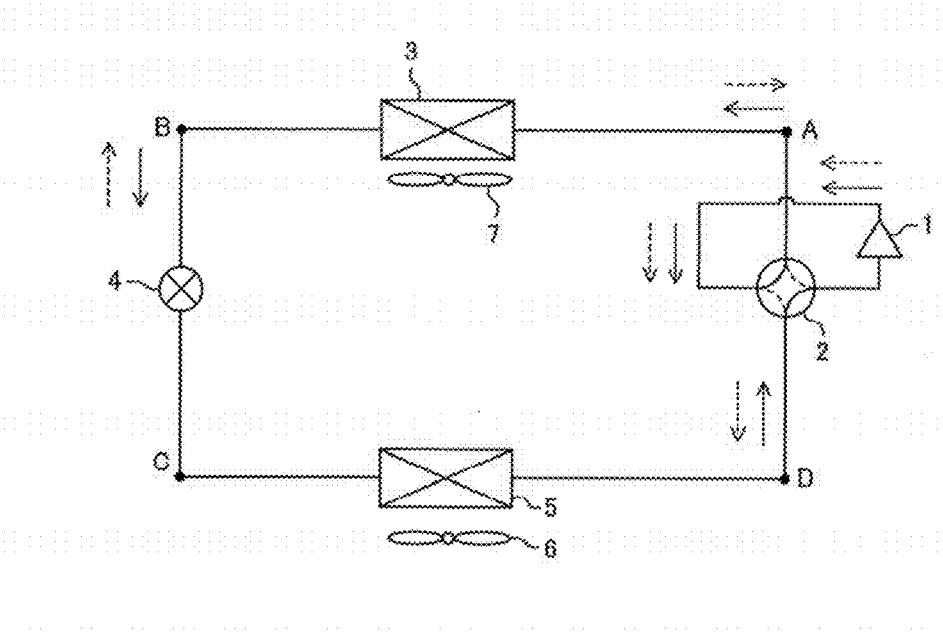
FIG. 25 is a block diagram of an air-conditioning device according to Embodiment 5 of the present disclosure.

FIG. 25 is a block diagram of an air-conditioning device according to Embodiment 5 of the present disclosure. In FIG. 25, the solid arrows indicate a flow of refrigerant during cooling, and the dotted arrows indicate a flow of refrigerant during heating.

The air-conditioning device has a compressor 1, a four-way valve 2, an outdoor heat exchanger 3, an expansion valve 4, and an indoor heat exchanger 5, and these components are connected through pipes to form a refrigerant circuit through which refrigerant circulates. The refrigerant circuit has refrigerating machine oil mixed therein to reduce deterioration of compression efficiency and deterioration of durability life due to wear in the compressor 1, and a portion of the refrigerating machine oil circulates through the refrigerant circuit together with the refrigerant. The air-conditioning device further includes a fan 7 configured to blow air to the outdoor heat exchanger 3 and a fan 6 configured to blow air to the indoor heat exchanger 5. The heat exchangers of Embodiments 1 to 4 may be applied to the outdoor heat exchanger 3 or may be applied to the indoor heat exchanger 5.

During cooling operation of the air-conditioning device thus configured, high-temperature and high-pressure gas refrigerant compressed by the compressor 1 passes through the four-way valve 2 and reaches a point A. After having passed through the point A, the gas refrigerant flows into the outdoor heat exchanger 3. The outdoor heat exchanger 3 functions as a condenser. The gas refrigerant having flowed into the outdoor heat exchanger 3 is cooled by air blown by the fan 7 and reaches a point B in a liquefied state. The liquid refrigerant thus liquefied passes through the expansion valve 4 and thereby turns into two-phase refrigerant made up of a mixture of low-temperature and low-pressure gas refrigerant and liquid refrigerant, and the two-phase refrigerant reaches a point C. After that, the two-phase refrigerant having passed through the point C flows into the indoor heat exchanger 5. The indoor heat exchanger 5 functions as an evaporator. The two-phase refrigerant having flowed into the indoor heat exchanger 5 is heated by air blown by the fan 6 and reaches a point D in a gasified state. The gas refrigerant having passed through the point D returns to the compressor 1 after having passed through the four-way valve 2. Through this cycle, the cooling operation of cooling indoor air is performed.

During heating operation, the flows of refrigerant through the four-way valve 2 are interchanged so that the aforementioned flow is inverted. That is, the high-temperature and high-pressure gas refrigerant compressed by the compressor 1 flows to the point D after having passed through the four-way valve 2, and the refrigerant having passed through the indoor heat exchanger 5, the expansion valve 4, and the outdoor heat exchanger 3 reaches the point A and is taken by the four-way valve 2 into a flow passage to return to the compressor 1. Through this cycle, the heating operation of heating indoor air is performed.

Example configurations of fans and examples of the placement of a fan and a heat exchanger are described with reference to FIGS. 26 to 31.

Figure 26:
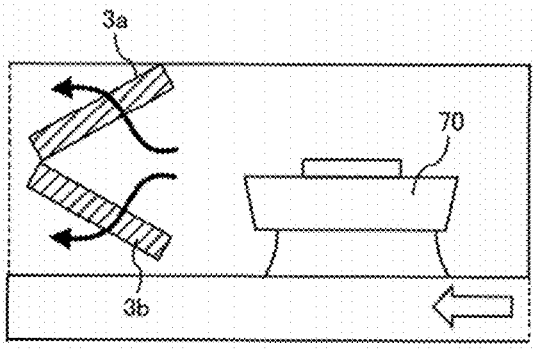
FIG. 26 is a schematic view showing a relationship between a heat exchanger and a turbo fan in the air-conditioning device according to Embodiment 5 of the present disclosure.

FIG. 26 is a schematic view showing a relationship between a heat exchanger and a turbo fan in the air-conditioning device according to Embodiment 5 of the present disclosure.

In this example, the turbo fan 70 is disposed on the windward side of the heat exchanger.

Figure 27:
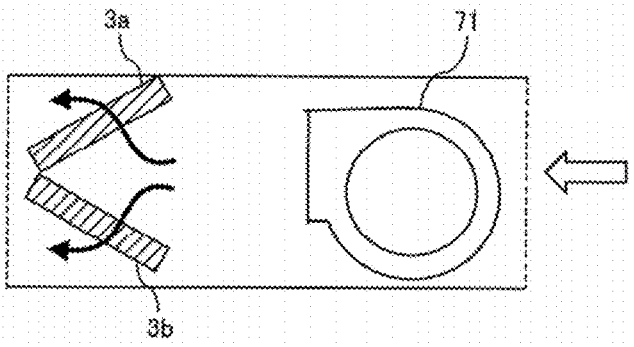
FIG. 27 is a schematic view showing a relationship between the heat exchanger and a sirocco fan in the air-conditioning device according to Embodiment 5 of the present disclosure.

FIG. 27 is a schematic view showing a relationship between the heat exchanger and a sirocco fan in the air-conditioning device according to Embodiment 5 of the present disclosure.

In this example, the sirocco fan 71 is disposed on the windward side of the heat exchanger.

Figure 28:
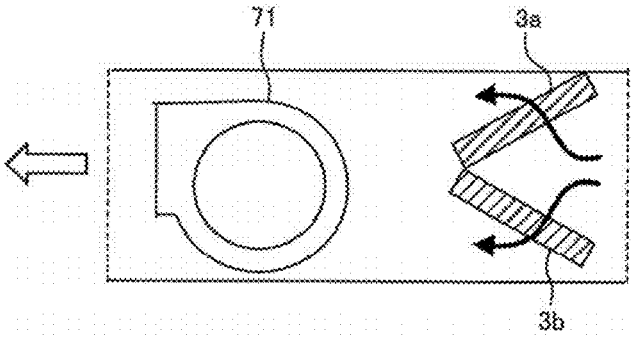
FIG. 28 is a schematic view showing a relationship between the heat exchanger and the sirocco fan in the air-conditioning device according to Embodiment 5 of the present disclosure.

FIG. 28 is a schematic view showing a relationship between the heat exchanger and the sirocco fan in the air-conditioning device according to Embodiment 5 of the present disclosure.

In this example, the sirocco fan 71 is disposed on the leeward side of the heat exchanger.

Figure 29:
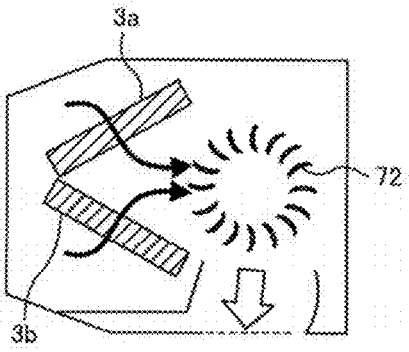
FIG. 29 is a schematic view showing a relationship between the heat exchanger and a line flow fan in the air-conditioning device according to Embodiment 5 of the present disclosure.

FIG. 29 is a schematic view showing a relationship between the heat exchanger and a line flow fan in the air-conditioning device according to Embodiment 5 of the present disclosure.

In this example, the line flow fan 72 is disposed on the leeward side of the heat exchanger.

Figure 30:
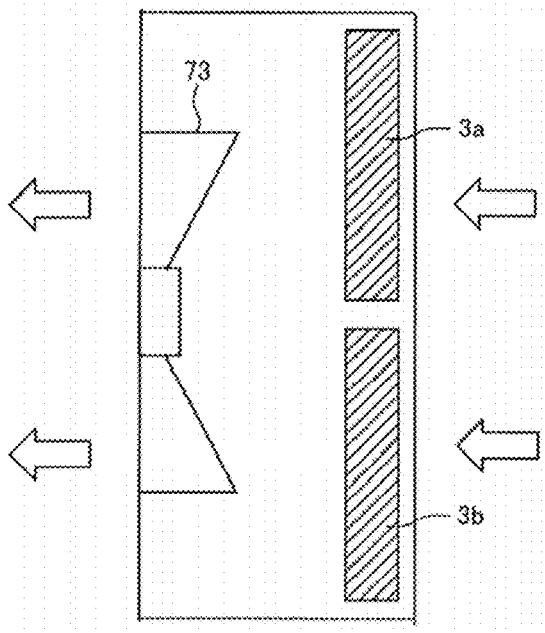
FIG. 30 is a schematic view showing a positional relationship between the heat exchanger and a propeller fan in the air-conditioning device according to Embodiment 5 of the present disclosure.

FIG. 30 is a schematic view showing a positional relationship between the heat exchanger and a propeller fan in the air-conditioning device according to Embodiment 5 of the present disclosure.

In this example, the propeller fan 73 is disposed on the leeward side of the heat exchanger.

Figure 31:
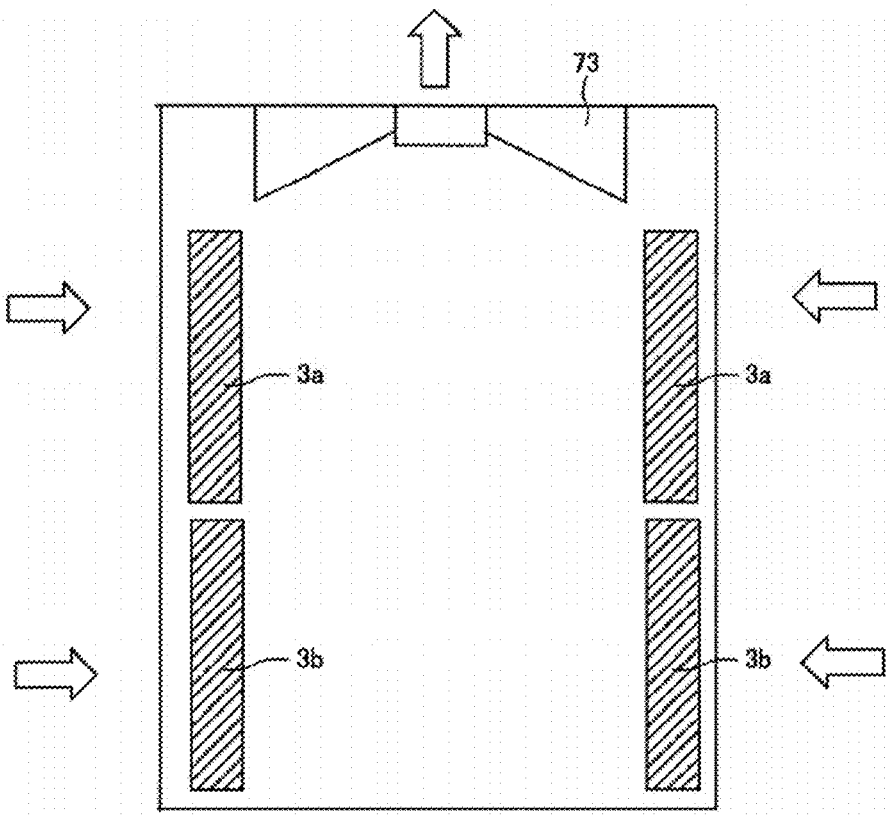
FIG. 31 is a schematic view showing a positional relationship between the heat exchanger and the propeller fan in the air-conditioning device according to Embodiment 5 of the present disclosure.

FIG. 31 is a schematic view showing a positional relationship between the heat exchanger and the propeller fan in the air-conditioning device according to Embodiment 5 of the present disclosure.

In this example, the propeller fan 73 is disposed on the leeward side of the heat exchanger. FIG. 31 differs from FIG. 30 in that while the heat exchanger and the propeller fan 73 are placed in FIG. 30 so that air flows in a linear fashion, the heat exchanger and the propeller fan 73 are placed in FIG. 31 so that air flows in a curved fashion.

As shown in FIGS. 26 to 31 above, a fan and a heat exchanger need only be placed so that air from the fan passes through the heat exchanger.

INDUSTRIAL APPLICABILITY

A heat exchanger according to an embodiment of the present disclosure is applicable, for example, to a heat pump device, a hot-water supply device, or a refrigeration device as well as the aforementioned air-conditioning device.

REFERENCE SIGNS LIST

1 compressor 2 four-way valve 3 outdoor heat exchanger 3*a* first heat exchange unit 3*b* second heat exchange unit 3*c* first heat exchange unit 3*d* second heat exchange unit 4 expansion valve 5 indoor heat exchanger 6 fan 7 fan 10 first header 11 first header 12 second header 13 second header second header 14*a* negative-side header 14*b* positive-side header 15 second header 15*a* negative-side header 15*b* positive-side header 16 third header 17 third header 18 intermediate header unit 19 first header 20 first header 21*a* first heat transfer pipe group 21*b* second heat transfer pipe group 21*c* third heat transfer pipe group 21*d* fourth heat transfer pipe group 22 fin 25 bifurcated pipe 25*a* bifurcated pipe 25*b* bifurcated pipe 30 first header 31 first header 32 second header 33 second header 34 second header 35 second header 36 third header 37 third header 40 first header 41 first header 43 second header 45 second header 46 third header 47 third header 51 header 51*a* header plate 51*aa* insertion hole 51*b* frame plate 51*c* header cover 61 header 61*a* header plate 61*aa* insertion hole 61*b* drift prevention plate 61*c* header cover 70 turbo fan 71 sirocco fan 72 line flow fan 73 propeller fan 101*a* U bend 101*b* U bend 110 upper inlet and outlet pipe 110*a* upper inlet and outlet pipe 110*b* upper inlet and outlet pipe 111 upper inlet and outlet pipe 112 connecting pipe 113 connecting pipe 114 connecting pipe 114*a* connecting pipe 114*b* connecting pipe 115 connecting pipe 115*a* connecting pipe 115*b* connecting pipe 116 lower inlet and outlet pipe 117 lower inlet and outlet pipe 118 communicating unit 118*a* first communicating pipe 118*b* second communicating pipe 140 divider 150 divider 180 intermediate header unit 300*a* negative-side heat exchanger 300*b* positive-side heat exchanger 310 inlet and outlet pipe 311 inlet and outlet pipe 312 connecting pipe 313 connecting pipe 314 connecting pipe 315 connecting pipe 316 connecting pipe 317 connecting pipe 320 connecting unit 410 connecting pipe 411 connecting pipe 416 inlet and outlet pipe 510 connecting pipe

The invention claimed is:

1. A heat exchanger comprising a first heat exchange unit and a second heat exchange unit disposed one above an other, the first heat exchange unit and the second heat exchange unit each having a heat transfer pipe group configured such that a plurality of heat transfer pipes, extending in a first orientation, through which refrigerant flows, are also arranged in parallel rows in a second orientation orthogonal to the first orientation, the heat transfer pipe groups of each of the first heat exchange unit and the second heat exchange unit being arranged in at least two rows in a third orientation, the first orientation being an up-and-down direction, the third orientation being a flow direction of air along a horizontal direction, the heat transfer pipe groups include a first heat transfer pipe group on a windward side of the first heat exchange unit, a second heat transfer pipe group on a leeward side of the first heat exchange unit, a third heat transfer pipe group on a windward side of the second heat exchange unit, and a fourth heat transfer pipe group on a leeward side of the second heat exchange unit, the heat exchanger including an intermediate header unit through which a lower end of the first heat transfer pipe group and a lower end of the second heat transfer pipe group communicate with an upper end of the third heat transfer pipe group and an upper end of the fourth heat transfer pipe group, in a case where the heat exchanger functions as a condenser, the intermediate header unit causing at least a portion of refrigerant having flowed downward through the first heat transfer pipe group and flowed out through the lower end of the first heat transfer pipe group to flow in through the upper end of the fourth heat transfer pipe group and flow downward through the fourth heat transfer pipe group and causing at least a portion of refrigerant having flowed downward through the second heat transfer pipe group and flowed out through the lower end of the second heat transfer pipe group to flow in through the upper end of the third heat transfer pipe group or the upper end of the fourth heat transfer pipe group and flow downward through the third heat transfer pipe group or the fourth heat transfer pipe group.

2. The heat exchanger of claim 1, further comprising:

two first headers connected to respective upper ends of the first heat transfer pipe group and the second heat transfer pipe group;

the intermediate header unit having four second headers; and two third headers connected to respective lower ends of the third heat transfer pipe group and the fourth heat transfer pipe group, wherein two of the four second headers of the intermediate header unit are connected to the respective lower ends of the first heat transfer pipe group and the second heat transfer pipe group, remaining two of the four second headers of the intermediate header unit are connected to the respective upper ends of the third heat transfer pipe group and the fourth heat transfer pipe group, and the intermediate header unit includes a communicating unit through which upper two of the second headers communicate with lower two of the second headers.

3. The heat exchanger of claim 2, wherein the communicating unit has a first communicating pipe one end of which is connected to the second header at the lower end of the first heat transfer pipe group and an other end of which is connected to the second header at the upper end of the fourth heat transfer pipe group and a second communicating pipe one end of which is connected to the second header at the lower end of the second heat transfer pipe group and an other end of which is connected to the second header at the upper end of the third heat transfer pipe group.

4. The heat exchanger of claim 3, wherein both the first communicating pipe and the second communicating pipe are connected to a same side that is either a positive side or a negative side of the second orientation.

5. The heat exchanger of claim 4, further comprising:

two upper inlet and outlet pipes connected to the two first headers connected to the respective upper ends of the first heat transfer pipe group and the second heat transfer pipe group; and two lower inlet and outlet pipes connected to the two third headers connected to the respective lower ends of the third heat transfer pipe group and the fourth heat transfer pipe group, wherein the two upper inlet and outlet pipes and the two lower inlet and outlet pipes are connected to the same side as the first communicating pipe and the second communicating pipe in the second orientation so that in the first heat exchange unit, the two first headers connected to the upper ends and the two second headers connected to the lower ends are opposite in refrigerant flow direction to each other and, in the second heat exchange unit, the two second headers connected to the upper ends and the two third headers connected to the lower ends are opposite in refrigerant flow direction to each other.

6. The heat exchanger of claim 4, further comprising:

two upper inlet and outlet pipes connected to the two first headers connected to the respective upper ends of the first heat transfer pipe group and the second heat transfer pipe group; and two lower inlet and outlet pipes connected to the two third headers connected to the respective lower ends of the third heat transfer pipe group and the fourth heat transfer pipe group, wherein the two upper inlet and outlet pipes and the two lower inlet and outlet pipes are connected to a side opposite to the first communicating pipe and the second communicating pipe in the second orientation so that in the first heat exchange unit, the two first headers connected to the upper ends and the two second headers connected to the lower ends are identical in refrigerant flow direction to each other and, in the second heat exchange unit, the two second headers connected to the upper ends and the two third headers connected to the lower ends are identical in refrigerant flow direction to each other.

7. The heat exchanger of claim 2, wherein each of the two second headers connected to the respective upper ends of the third heat transfer pipe group and the fourth heat transfer pipe group has an interior divided at a center of the second orientation to form a positive-side header and a negative-side header, and the communicating unit has a first communicating pipe one end of which is connected to the second header connected to the lower end of the first heat transfer pipe group and an other end of which is bifurcated to be connected to the respective positive-side headers of the third heat transfer pipe group and the fourth heat transfer pipe group and a second communicating pipe one end of which is connected to the second header connected to the lower end of the second heat transfer pipe group and an other end of which is bifurcated to be connected to the respective negative-side headers of the third heat transfer pipe group and the fourth heat transfer pipe group (21*d*).

8. The heat exchanger of claim 7, wherein in a case where the heat exchanger functions as an evaporator, refrigerant having flowed into the third header connected to the lower end of the third heat transfer pipe group passes through the third heat transfer pipe group and flows into each of the positive-side header and the negative-side header of the second header connected to the upper end, refrigerant having flowed into the third header connected to the lower end of the fourth heat transfer pipe group passes through the fourth heat transfer pipe group and flows into the positive-side header and the negative-side header of the second header connected to the upper end, flows of the refrigerant having flowed into the positive-side headers at the respective upper ends of the third heat transfer pipe group and the fourth heat transfer pipe group merge after flowing out in a positive direction of the second orientation and flow in a negative direction of the second orientation into the second header connected to the lower end of the first heat transfer pipe group, and flows of the refrigerant having flowed into the negative-side headers at the respective upper ends of the third heat transfer pipe group and the fourth heat transfer pipe group merge after flowing out in the negative direction of the second orientation and flow in the positive direction of the second orientation into the second header connected to the lower end of the second heat transfer pipe group.

9. The heat exchanger of claim 2, wherein the communicating unit has a bifurcated pipe one end of which is bifurcated into two ends connected to the two second headers connected to the respective lower ends of the first heat transfer pipe group and the second heat transfer pipe group and an other end of which is connected to the second header connected to the upper end of the fourth heat transfer pipe group.

10. The heat exchanger of claim 1, wherein the heat exchanger is divided into two parts in the second orientation to form a negative-side heat exchanger and a positive-side heat exchanger and includes a connecting unit through which the negative-side heat exchanger and the positive-side heat exchanger are connected in series.

11. The heat exchanger of claim 10, wherein in a case where the heat exchanger functions as the condenser, a flow passage is formed through which refrigerant having flowed downward through the positive-side heat exchanger flows into the negative-side heat exchanger via the connecting unit, and the positive-side heat exchanger is twice or more as large in capacity as the negative-side heat exchanger.

12. The heat exchanger of claim 1, wherein an angle $\theta 1$ of the first heat exchange unit with respect to the third orientation is expressed as $0 \text{ degree} < \theta 1 \leq 90$ degrees, and an angle $\theta 2$ of the second heat exchange unit with respect to the third orientation is expressed as $90 \text{ degrees} \leq \theta 2 < 180$ degrees.

13. A refrigeration cycle device comprising the heat exchanger of claim 1.

* * * * *